US012137824B2

(12) United States Patent
Tanaka et al.

(10) Patent No.: US 12,137,824 B2
(45) Date of Patent: Nov. 12, 2024

(54) HOUSING BODY

(71) Applicant: Kura Sushi, Inc., Sakai (JP)

(72) Inventors: Kunihiko Tanaka, Sakai (JP); Makoto Tanaka, Sakai (JP)

(73) Assignee: KURA SUSHI, INC., Sakai (JP)

( * ) Notice: Subject to any disclaimer, the term of this patent is extended or adjusted under 35 U.S.C. 154(b) by 53 days.

(21) Appl. No.: 18/010,841

(22) PCT Filed: Jul. 9, 2021

(86) PCT No.: PCT/JP2021/026047
§ 371 (c)(1),
(2) Date: Dec. 16, 2022

(87) PCT Pub. No.: WO2022/009993
PCT Pub. Date: Jan. 13, 2022

(65) Prior Publication Data

US 2023/0218098 A1 Jul. 13, 2023

(30) Foreign Application Priority Data

Jul. 9, 2020 (JP) ..... 2020-118580
Oct. 2, 2020 (JP) ..... 2020-168123

(51) Int. Cl.
*A47G 23/08* (2006.01)

(52) U.S. Cl.
CPC ..... *A47G 23/08* (2013.01)

(58) Field of Classification Search
CPC ..... G06Q 50/12; A47G 23/08; A47F 10/02; A47F 10/06; B65G 35/06; B65G 43/08
(Continued)

(56) References Cited

U.S. PATENT DOCUMENTS 8,550,229 B2 * 10/2013 Tanaka ..... A47F 10/06 198/465.1
8,839,910 B2 * 9/2014 Tanaka ..... B65B 25/001 186/49
2014/0046480 A1 * 2/2014 Tanaka ..... G07F 9/105 700/225

FOREIGN PATENT DOCUMENTS

JP 7-255582 A 10/1995
JP H07255582 A * 10/1995
(Continued)

OTHER PUBLICATIONS

International Search Report for PCT/JP2021/026047 mailed on Aug. 10, 2021.
(Continued)

*Primary Examiner* — Gene O Crawford
*Assistant Examiner* — Muhammad Awais
(74) *Attorney, Agent, or Firm* — Birch, Stewart, Kolasch & Birch, LLP

(57) ABSTRACT

The present invention provides a housing body that is to house a container on which a food and/or beverage item is to be placed and that is to be transported along a transport path, the housing body including: a placement table having a placement position where the container is to be placed; a lid body that is attached to the placement table so as to be openable and closable; an opening/closing mechanism for causing the lid body to transition to a closed state when the container is placed at the placement position of the placement table, and causing the lid body to transition to an open state when the container is moved away from the placement position; and an operation portion for moving the container away from the placement position.

23 Claims, 20 Drawing Sheets

(58) Field of Classification Search
USPC ..... 198/465.1
See application file for complete search history.

(56) References Cited

FOREIGN PATENT DOCUMENTS

| | | | | |
|---|---|---|---|---|
| JP | 2000-23818 | A | | 1/2000 |
| JP | 2000023818 | A | * | 1/2000 |
| JP | 2001299553 | A | * | 10/2001 |
| JP | 2003300562 | A | * | 10/2003 |
| JP | 2013141520 | A | * | 7/2013 |
| JP | 2013150732 | A | * | 8/2013 |
| JP | 2014079294 | A | * | 5/2014 |
| JP | 2015015984 | A | * | 1/2015 |
| JP | 2015077392 | A | * | 4/2015 |
| JP | 2015085067 | A | * | 5/2015 |
| JP | 2017023430 | A | * | 2/2017 |
| JP | 2017196101 | A | * | 11/2017 |

OTHER PUBLICATIONS

Written Opinion of the International Searching Authority for PCT/JP2021/026047 mailed on Aug. 10, 2021.
Japanese Office Action for Japanese Application No. 2020-168123, dated Mar. 19, 2024, with English translation.
Taiwanese Office Action and Search Report for Taiwanese Application No. 110125309, dated Aug. 14, 2024, with English translation.

* cited by examiner

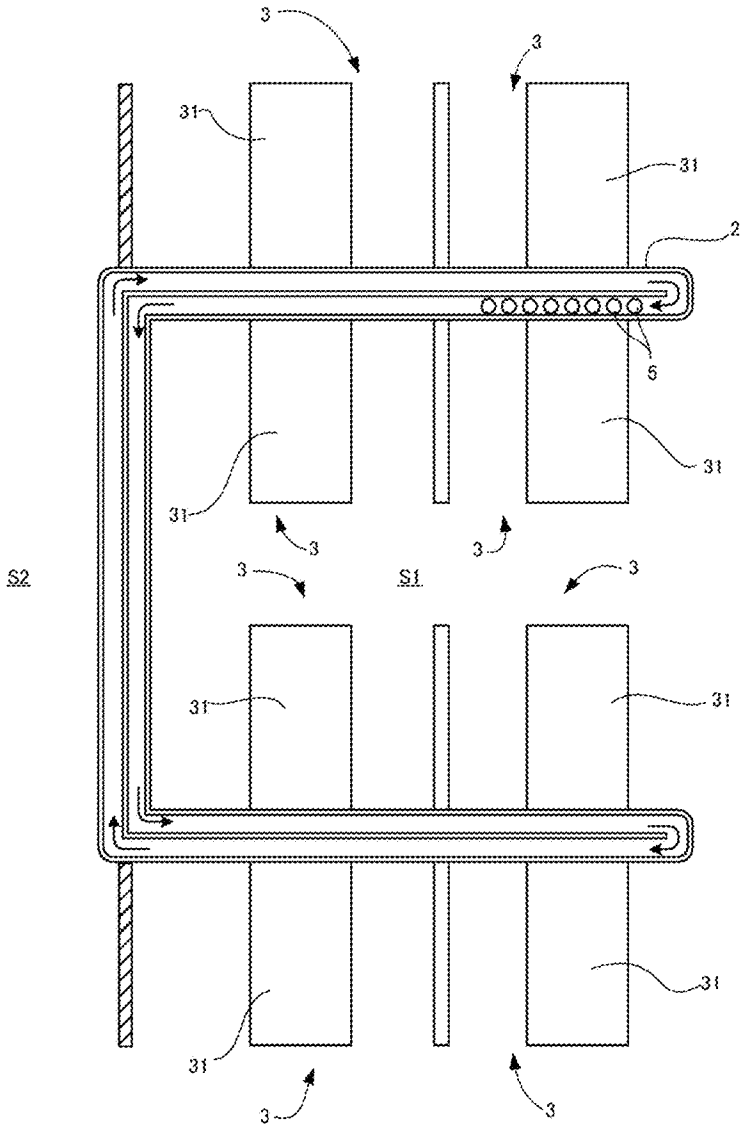
【FIG. 1】

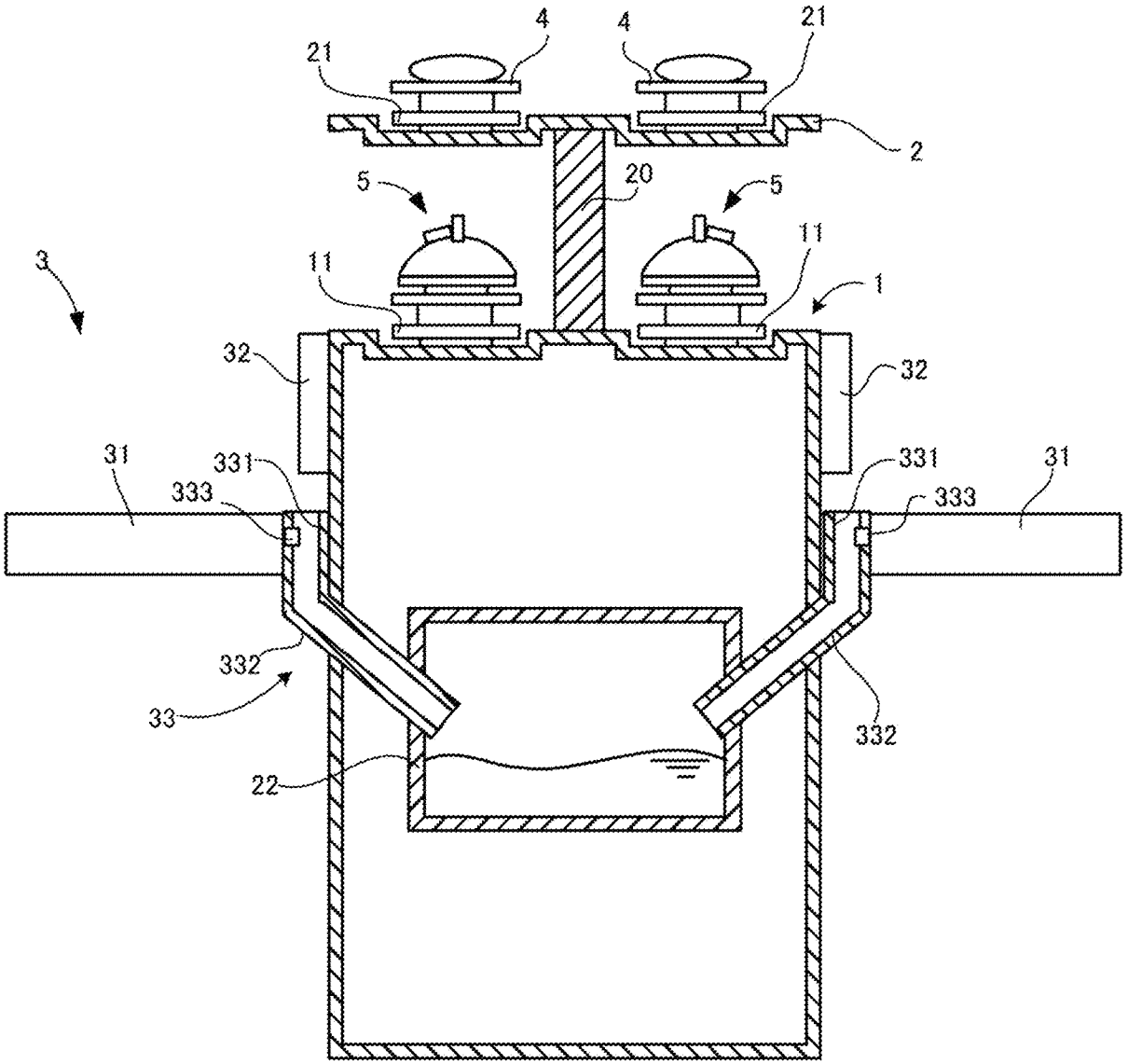
【FIG. 2】

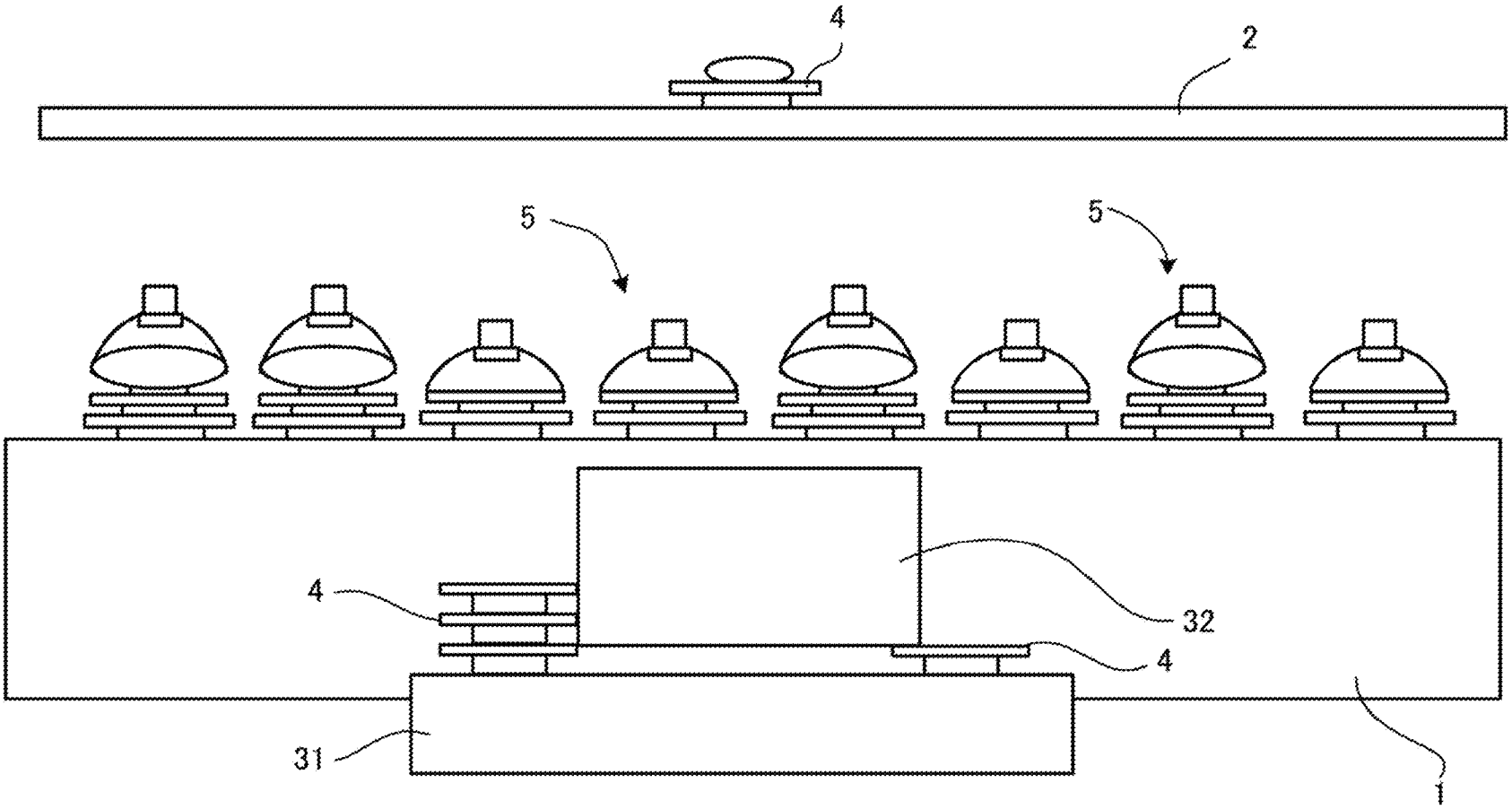
【FIG. 3】

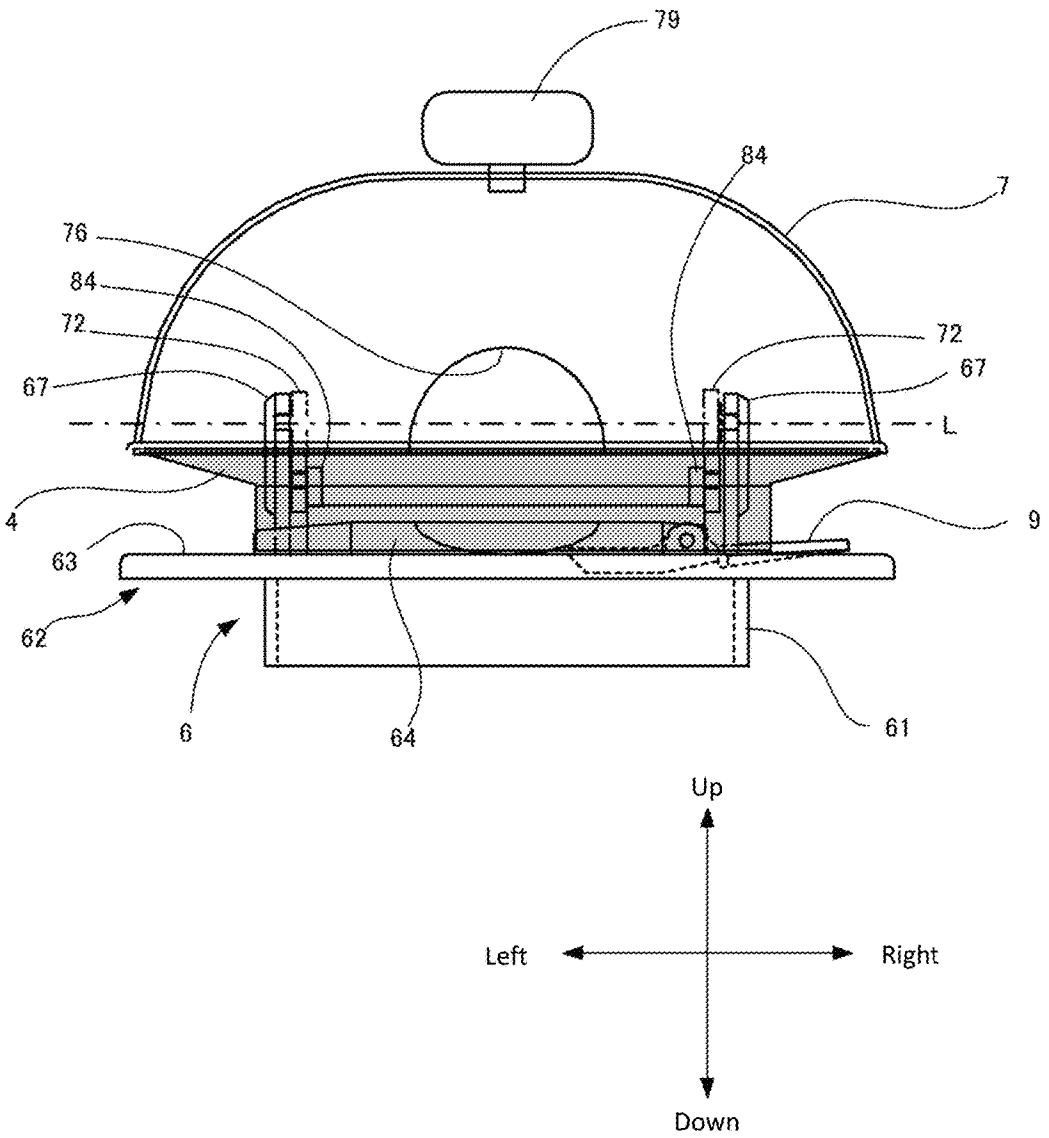
【FIG. 4】

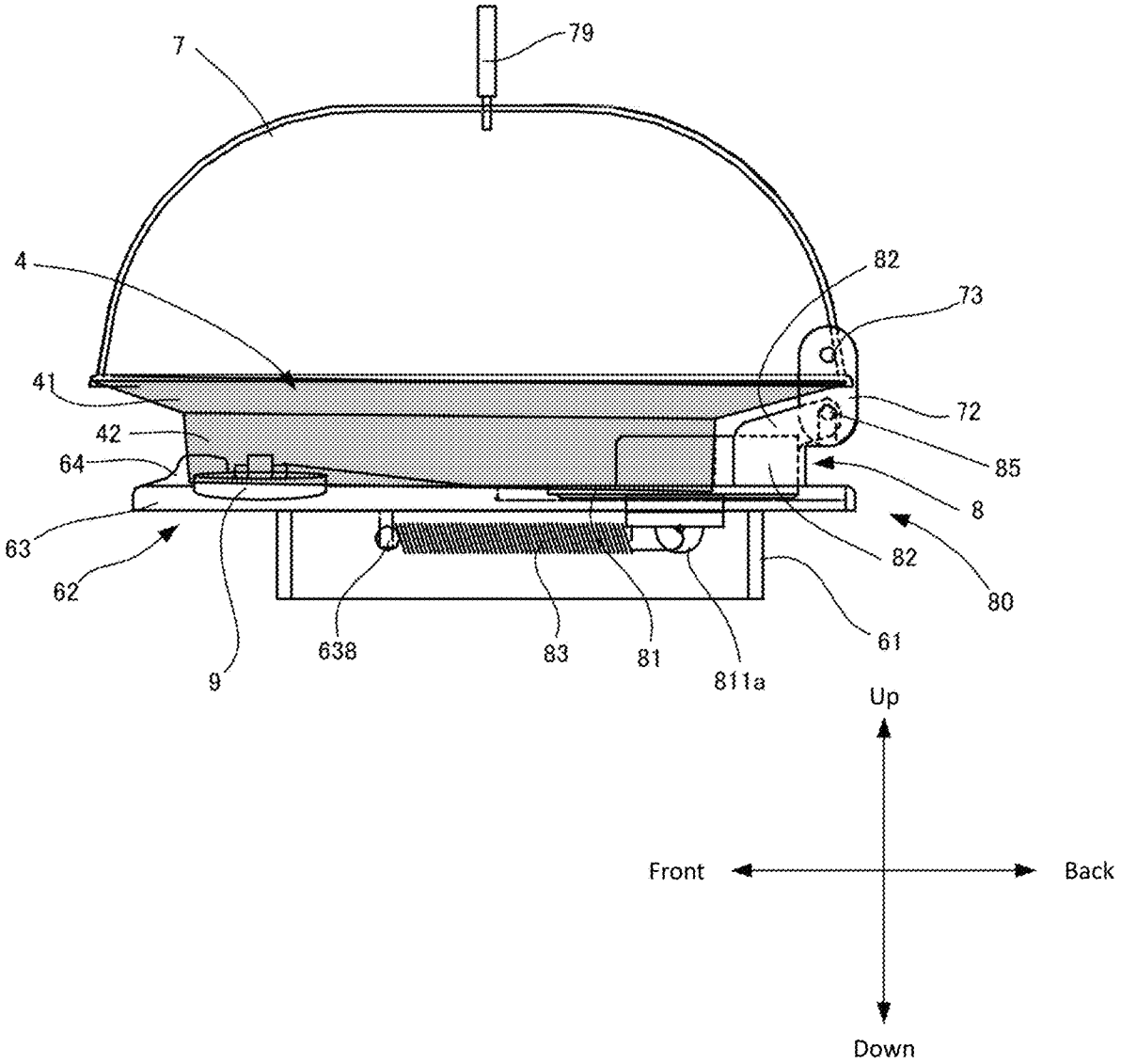
【FIG. 5】

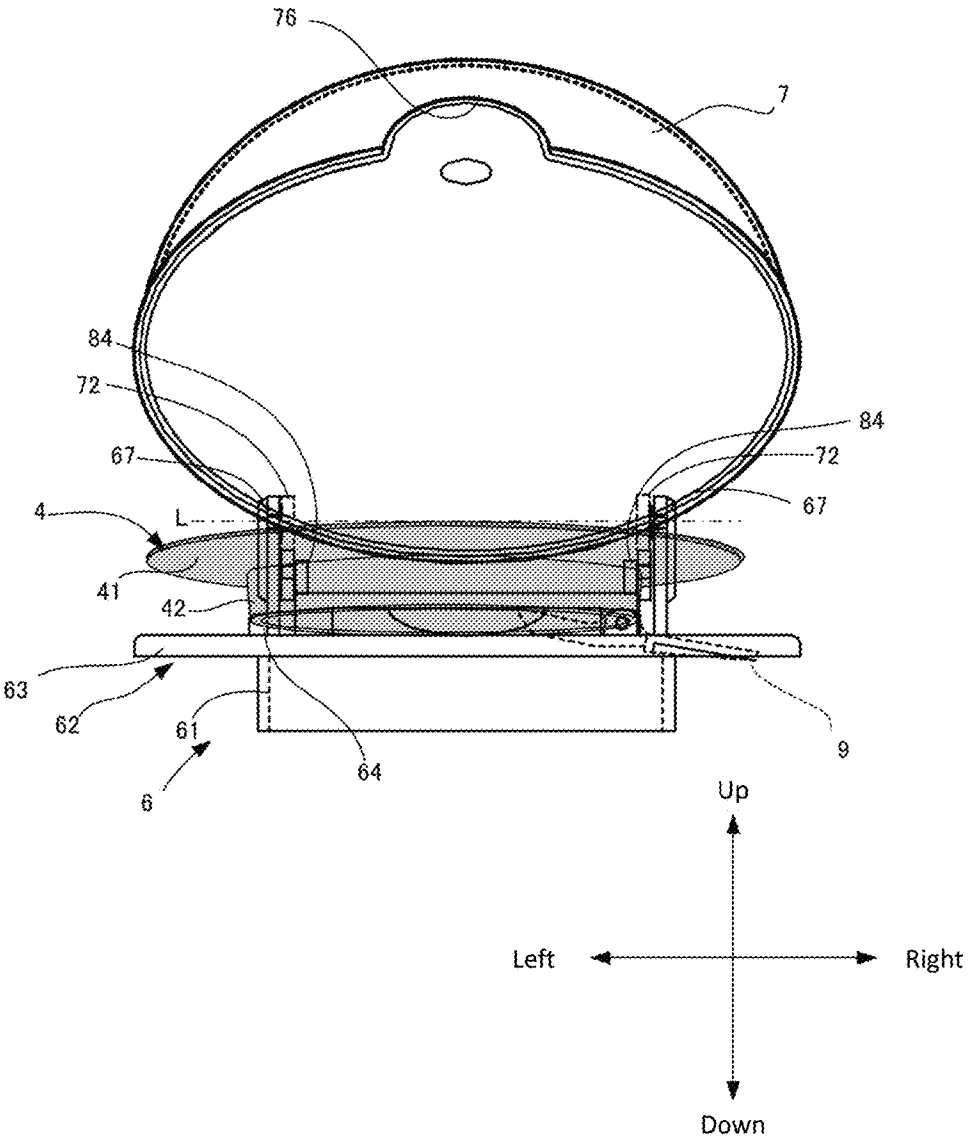
【FIG. 6】

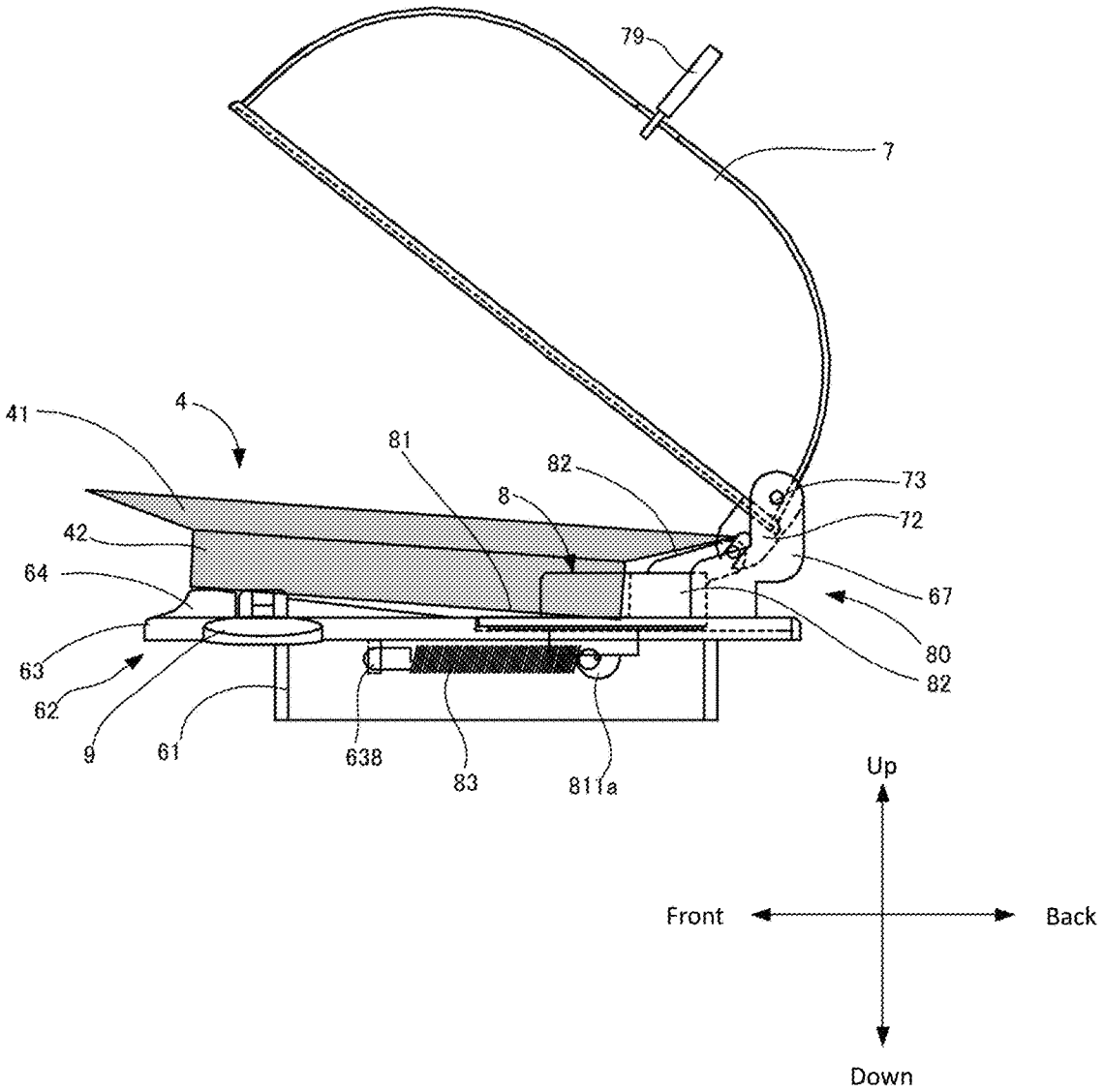
【FIG. 7】

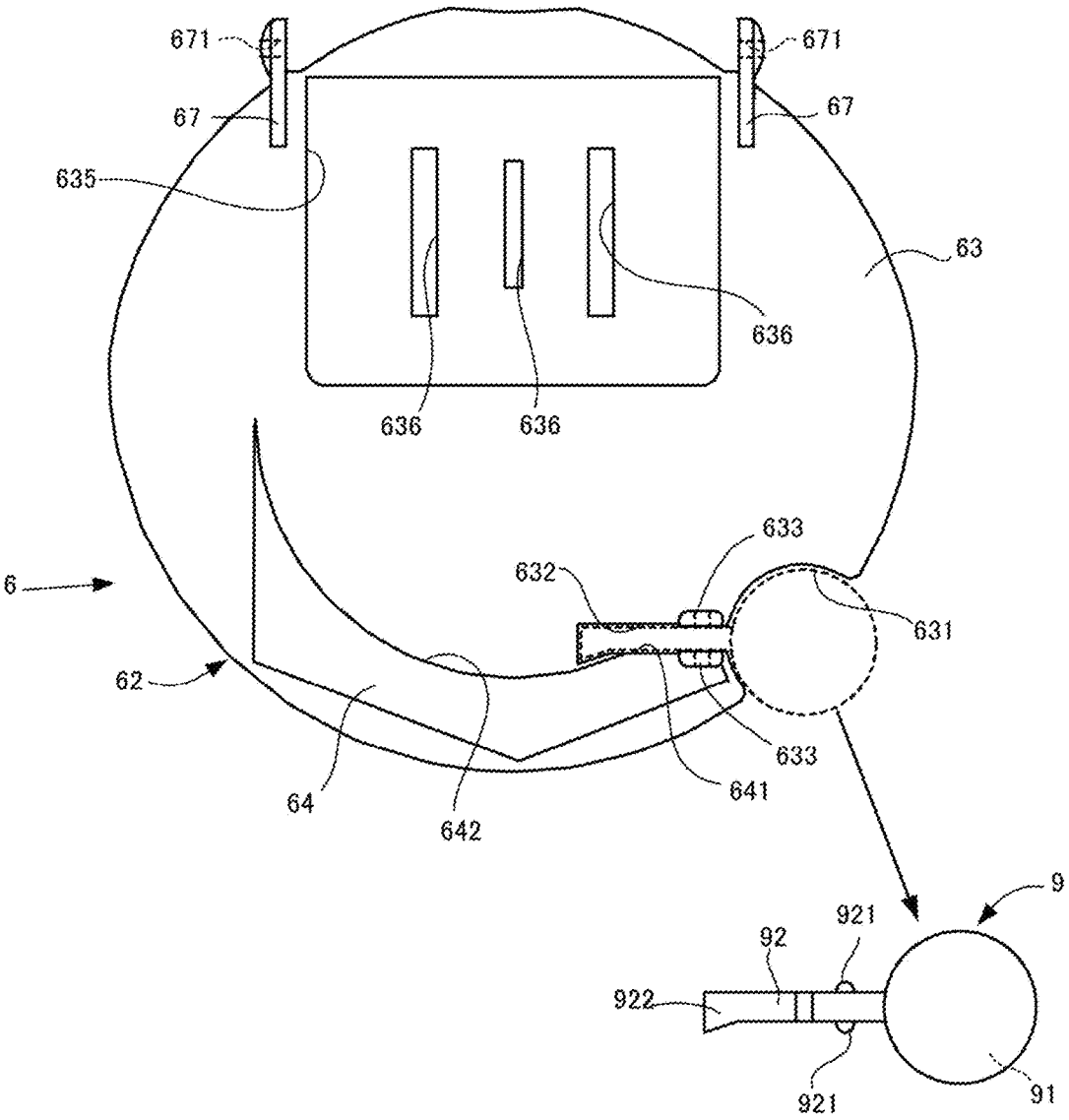
【FIG. 8】

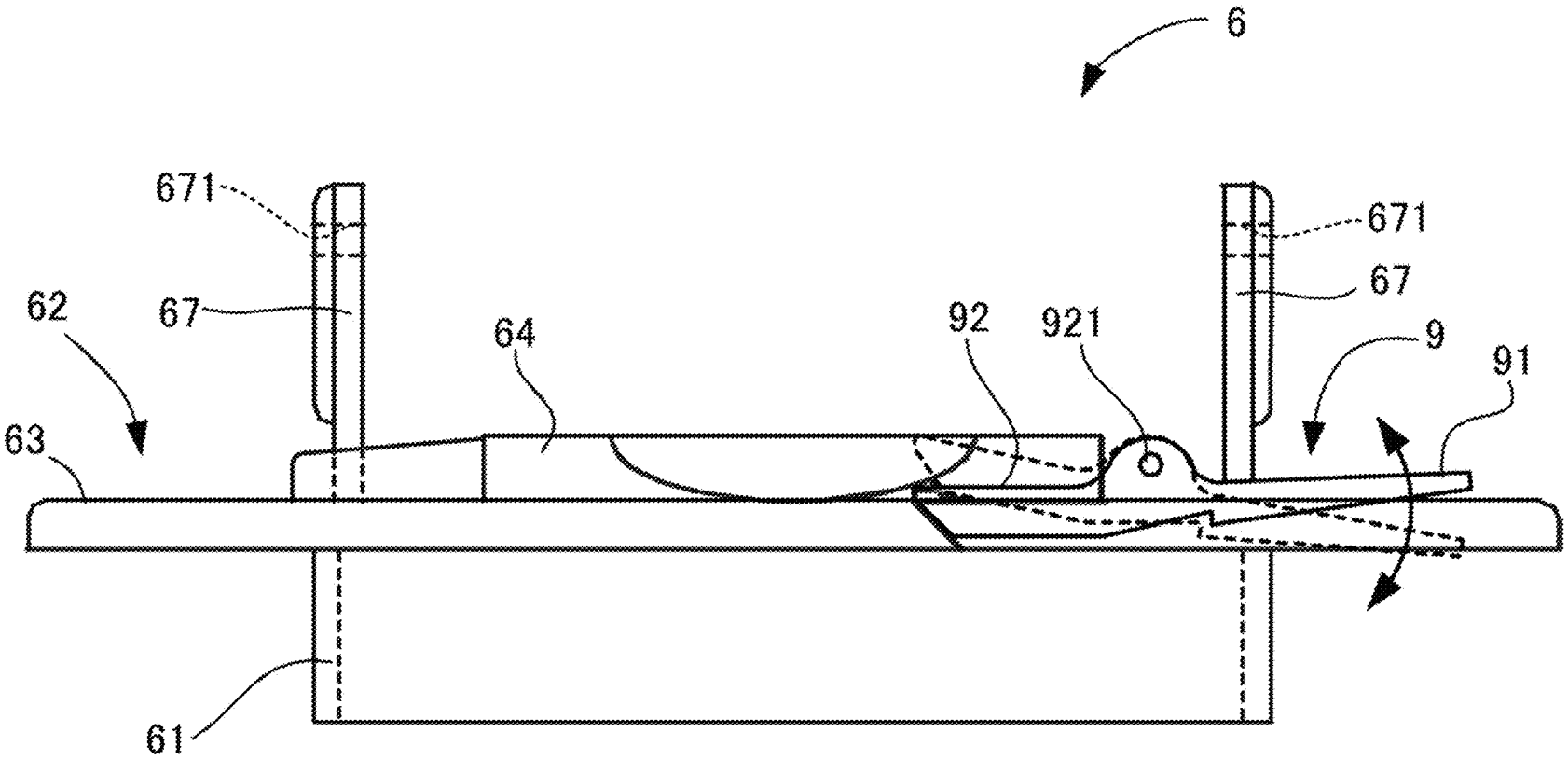
【FIG. 9】

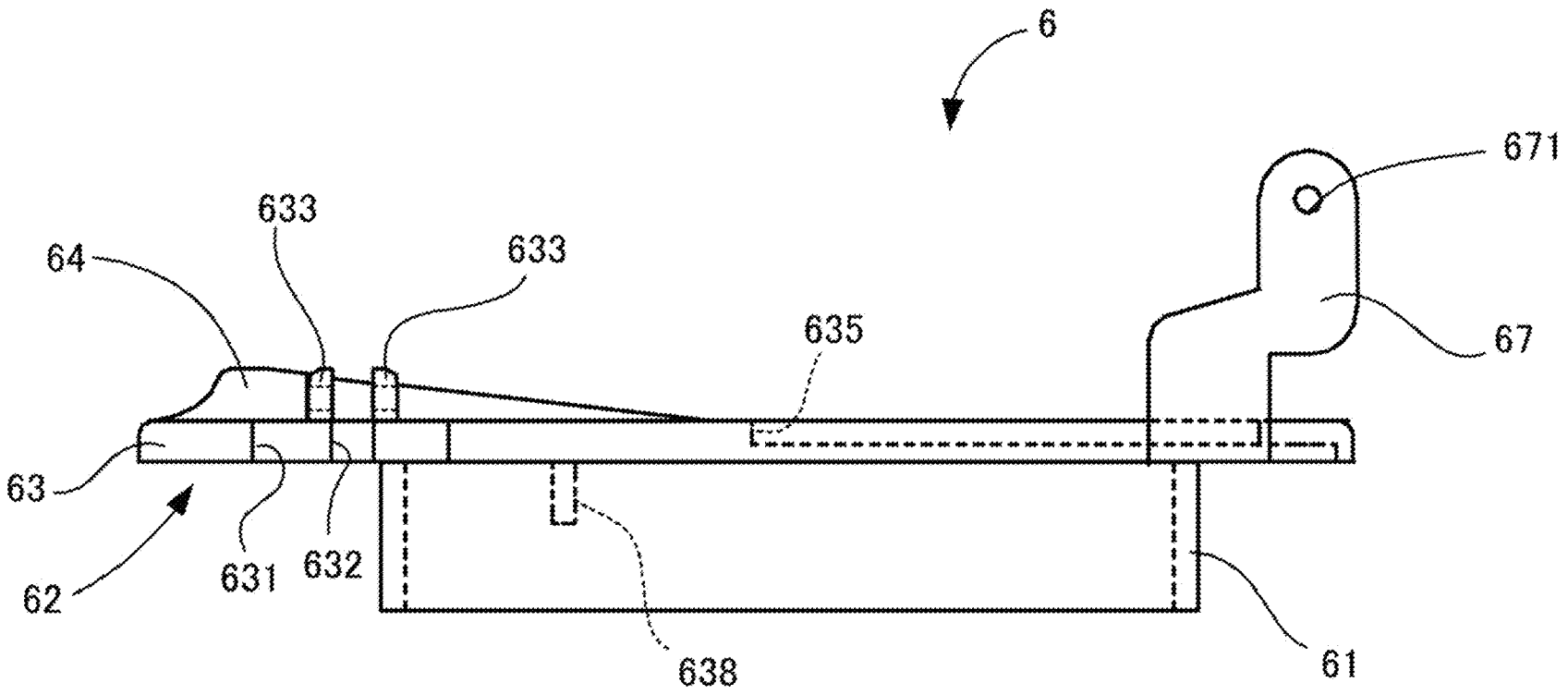
【FIG. 10】

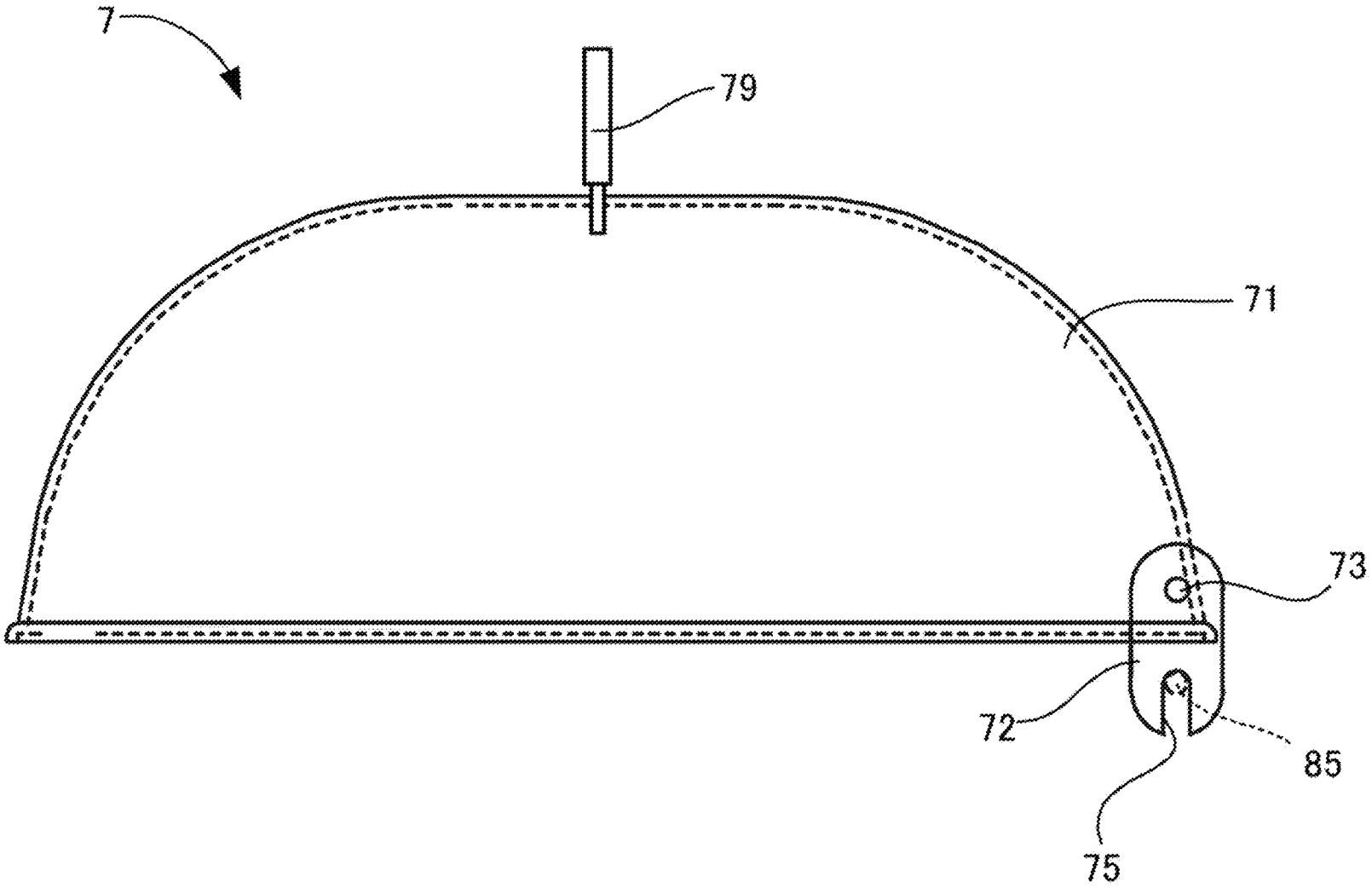
【FIG. 11】

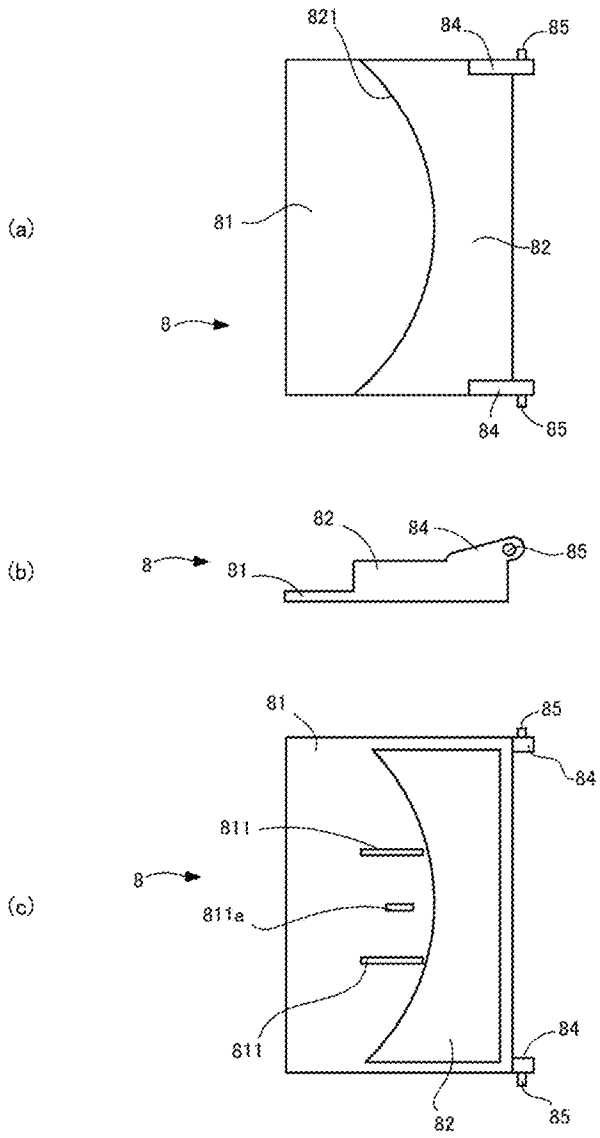
【FIG. 12】

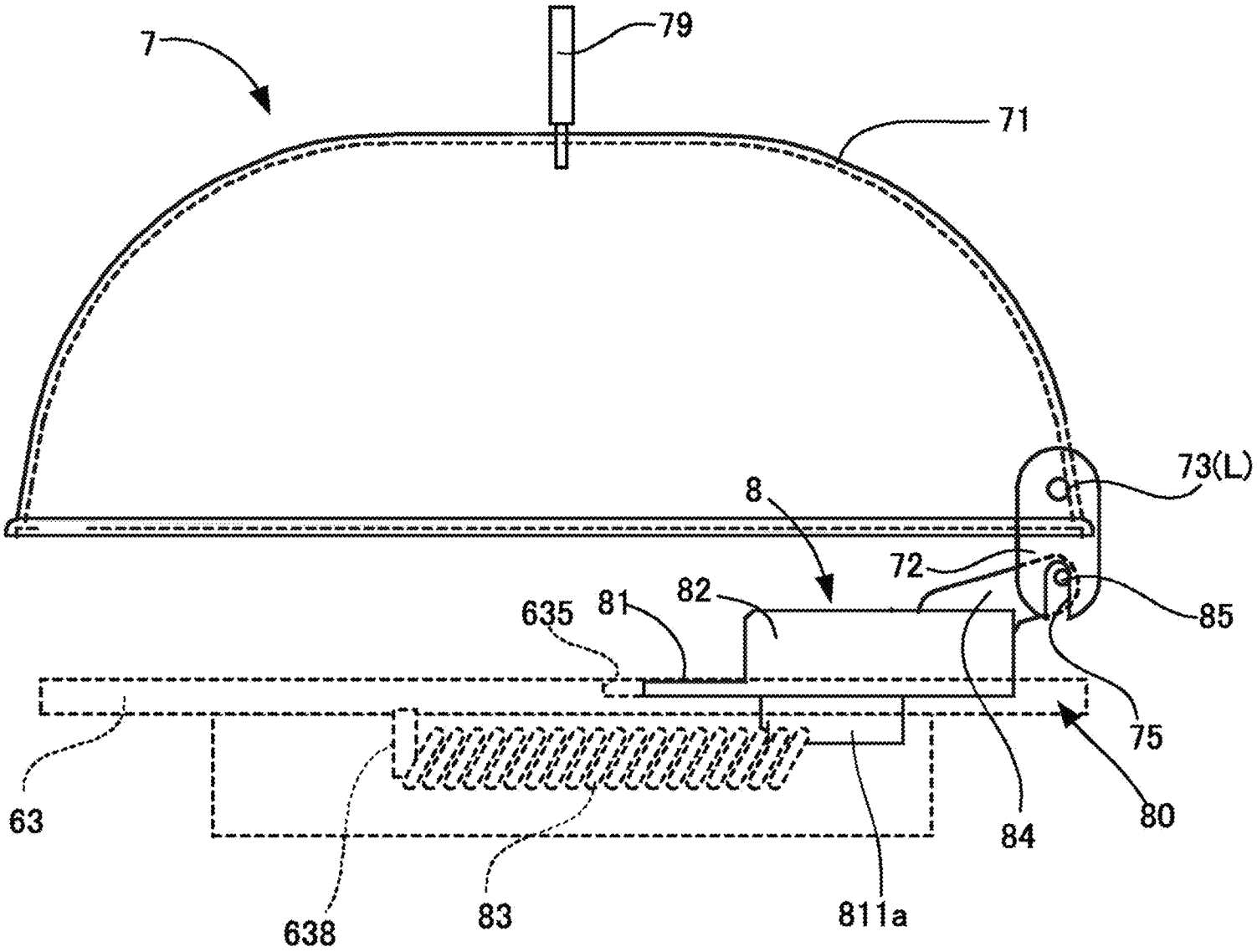
【FIG. 13】

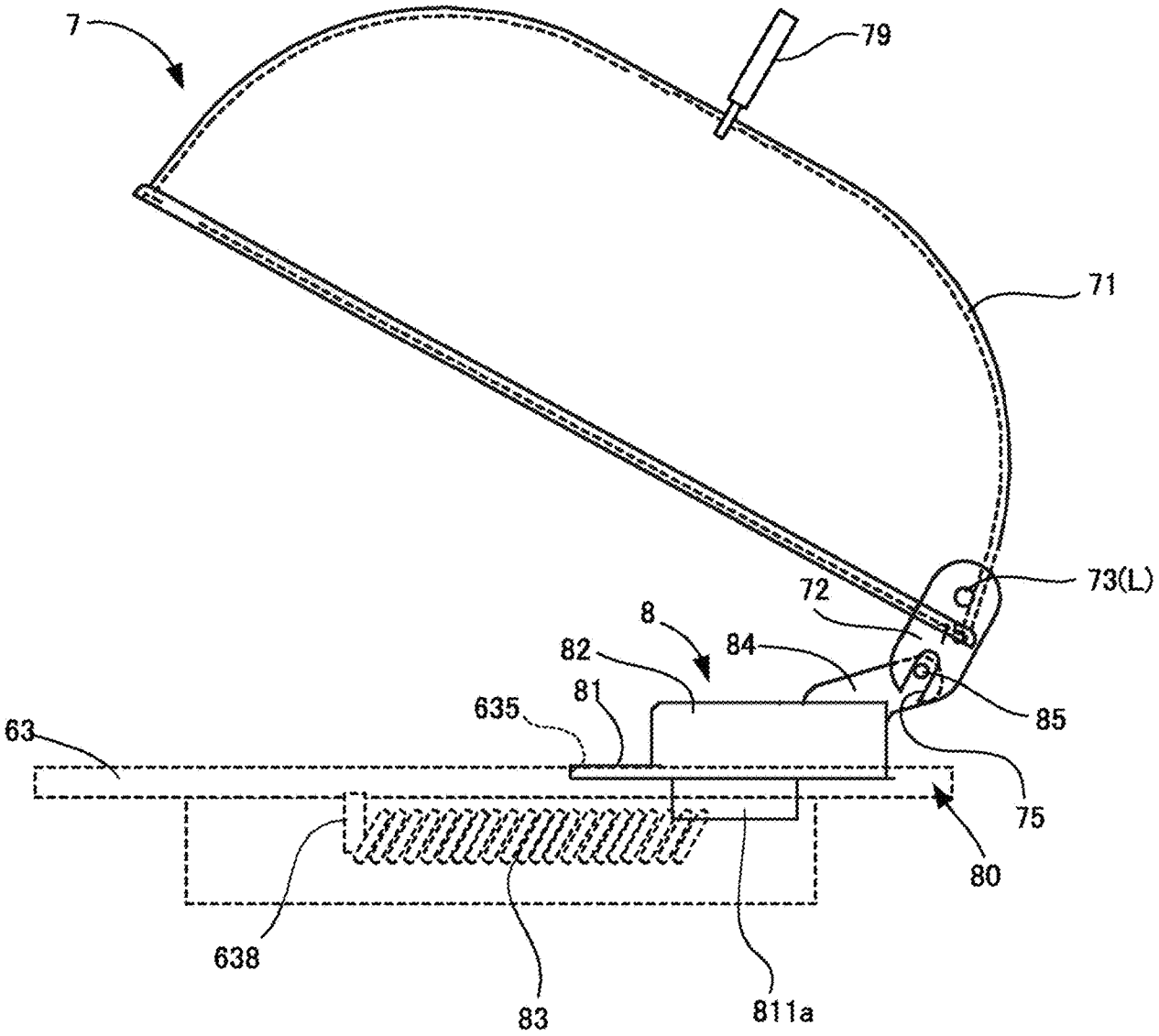
【FIG. 14】

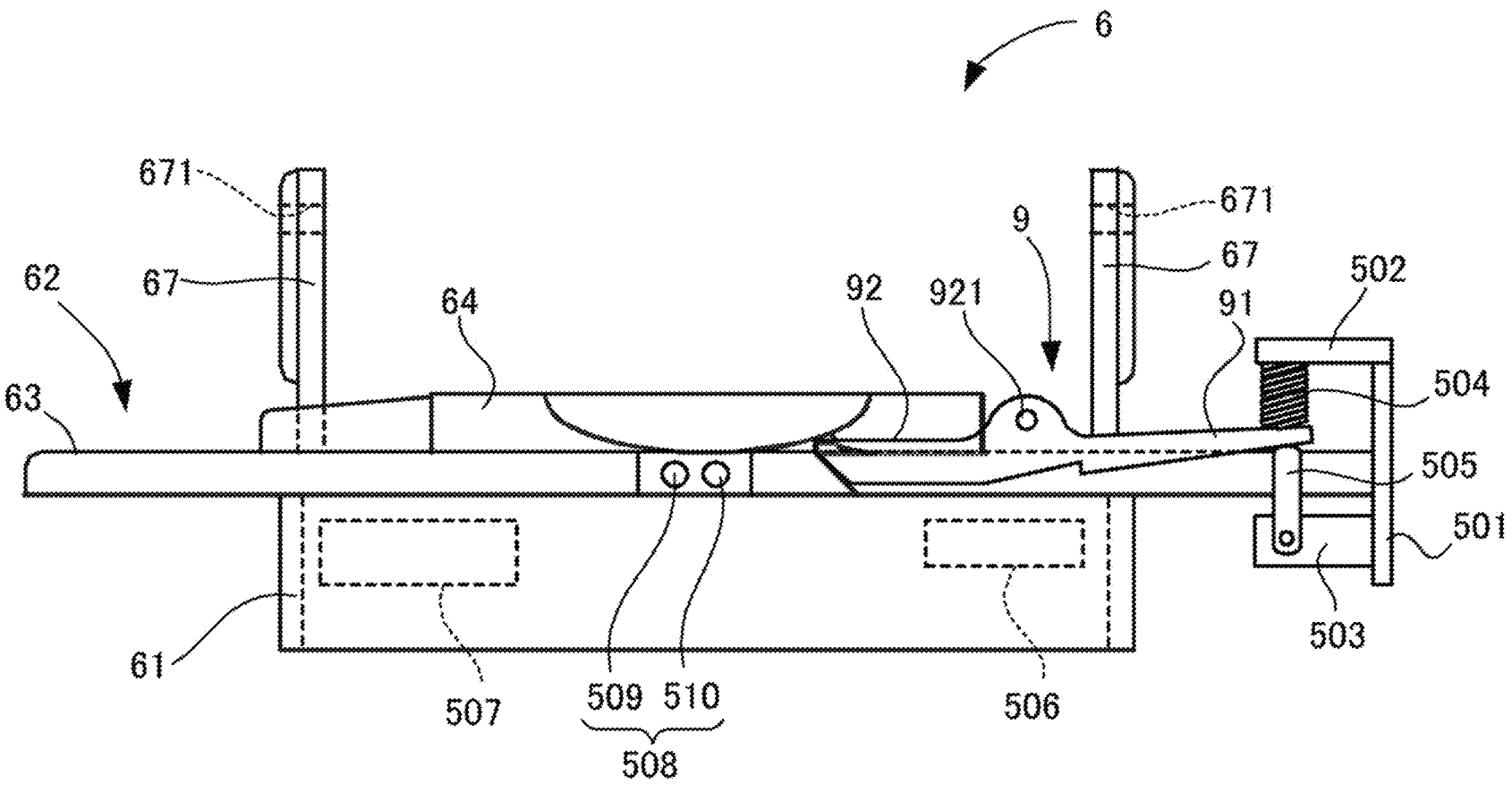
【FIG. 15】

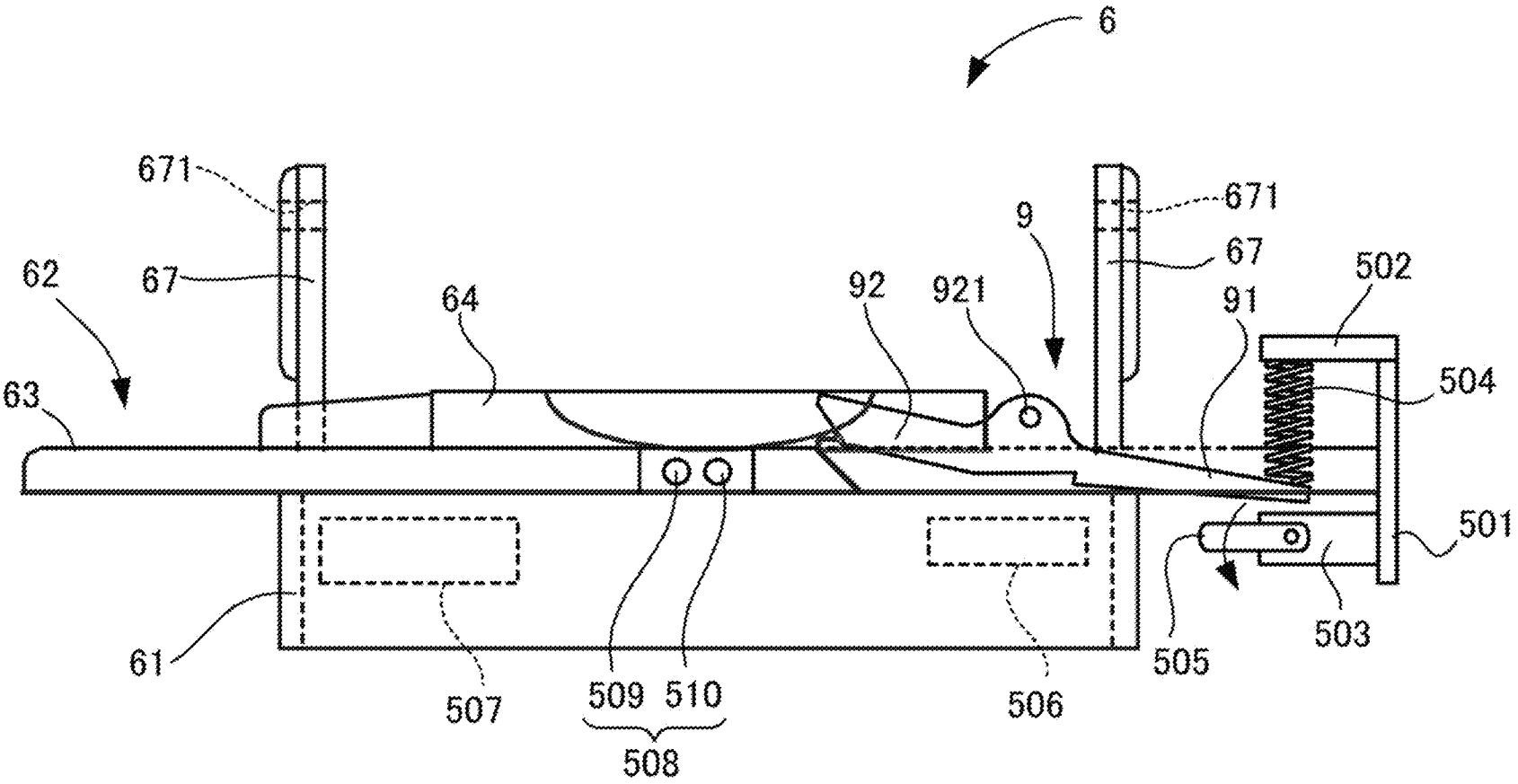
【FIG. 16】

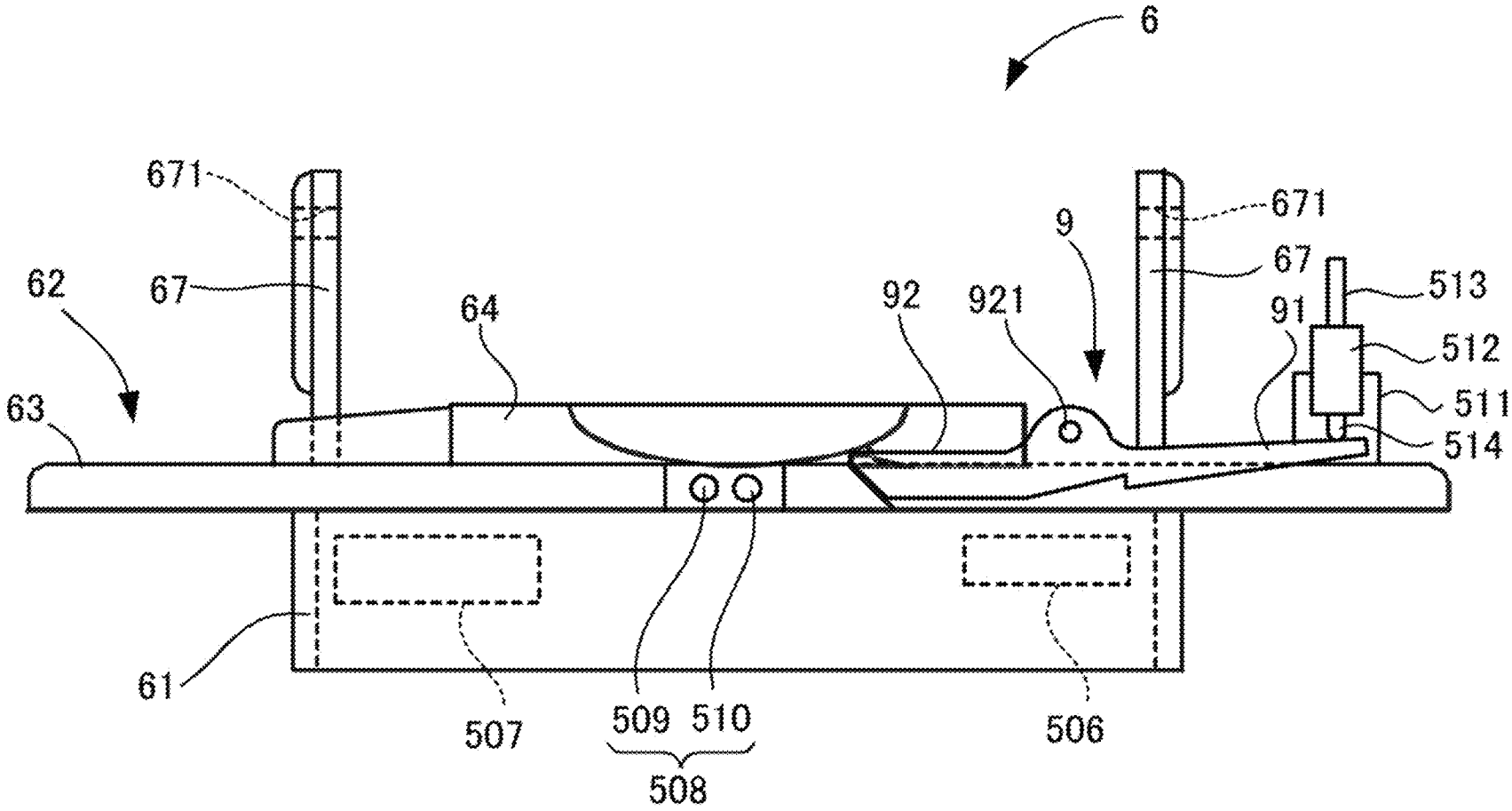
【FIG. 17】

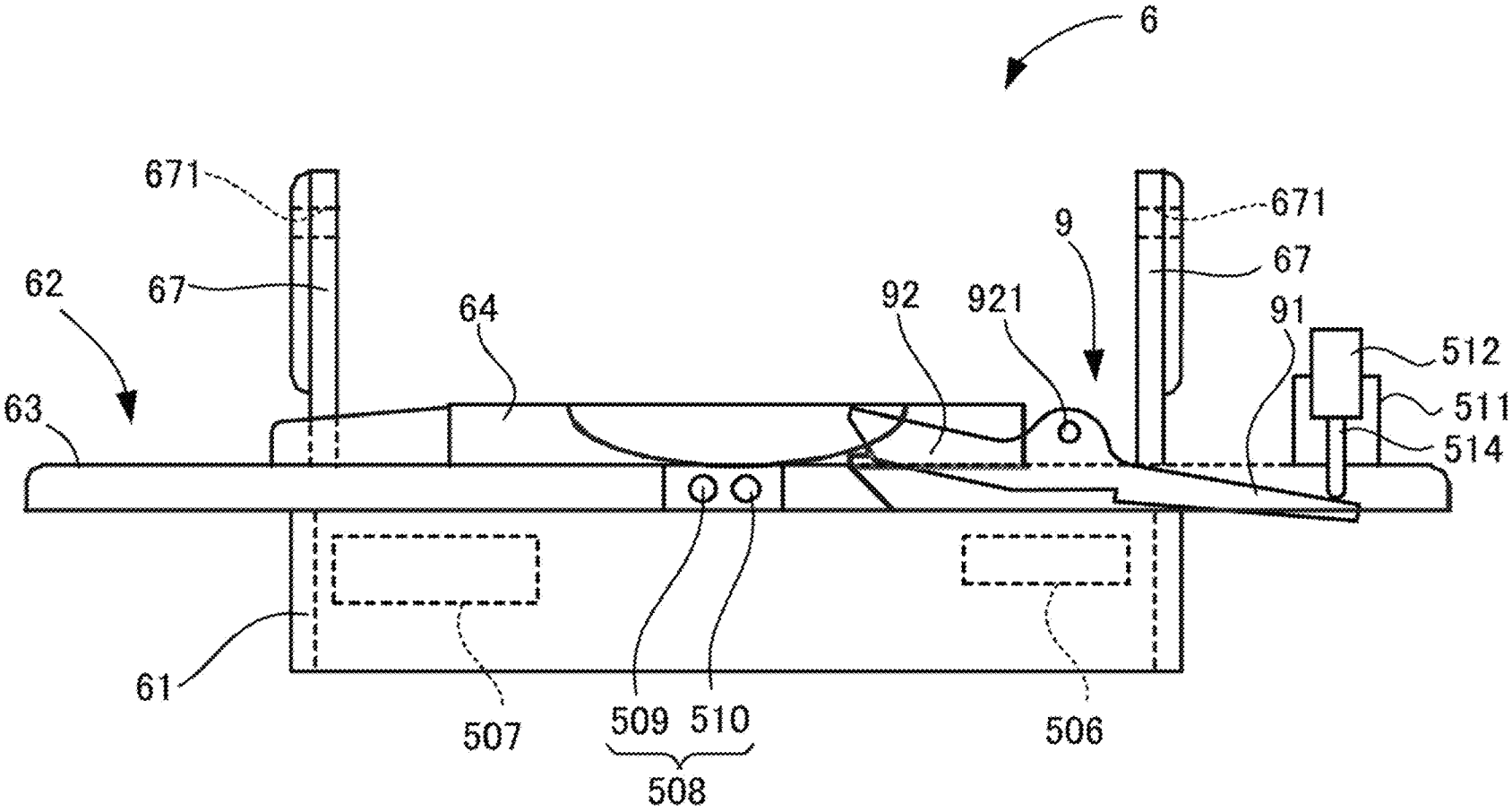
【FIG. 18】

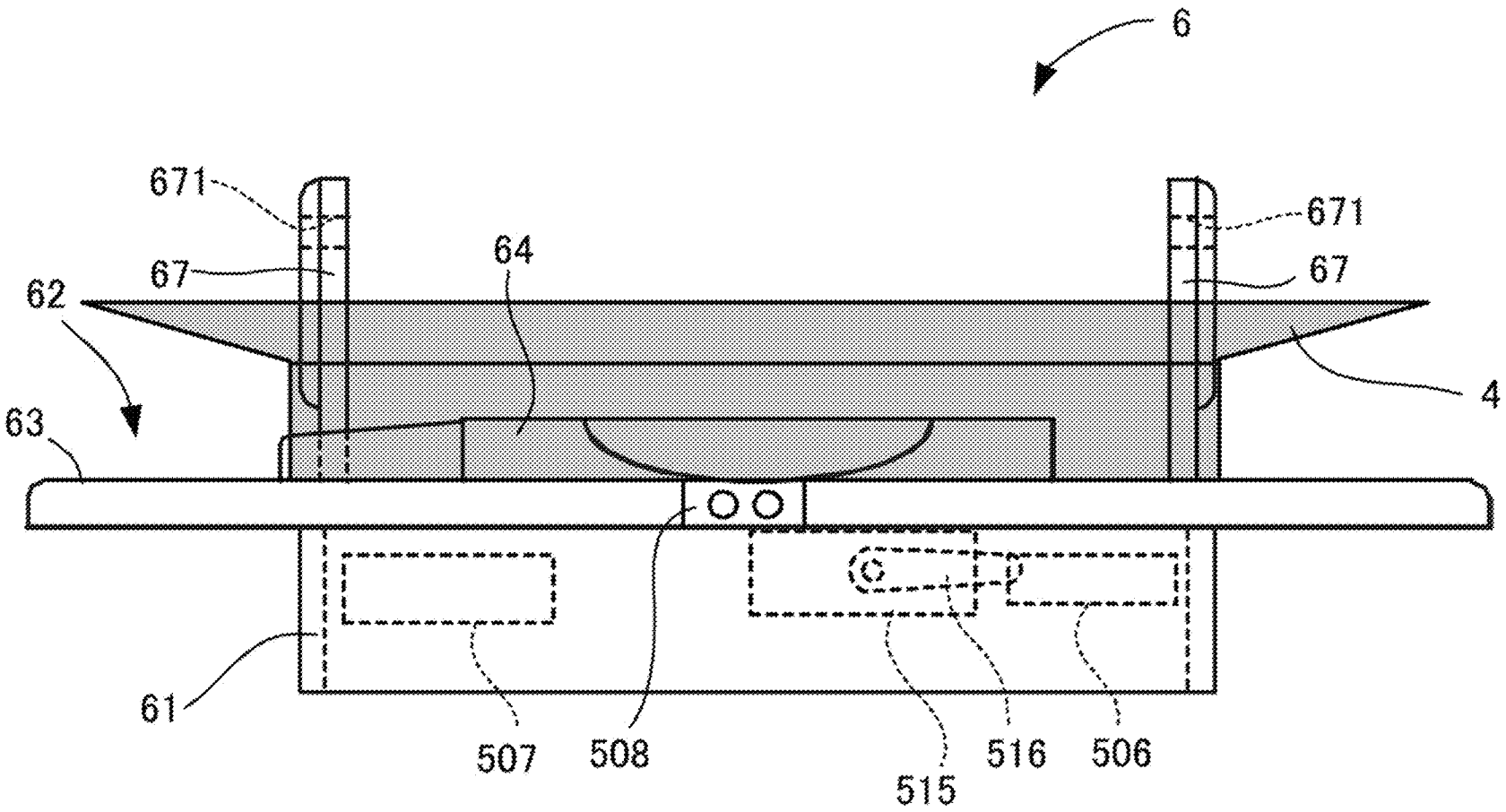
【FIG. 19】

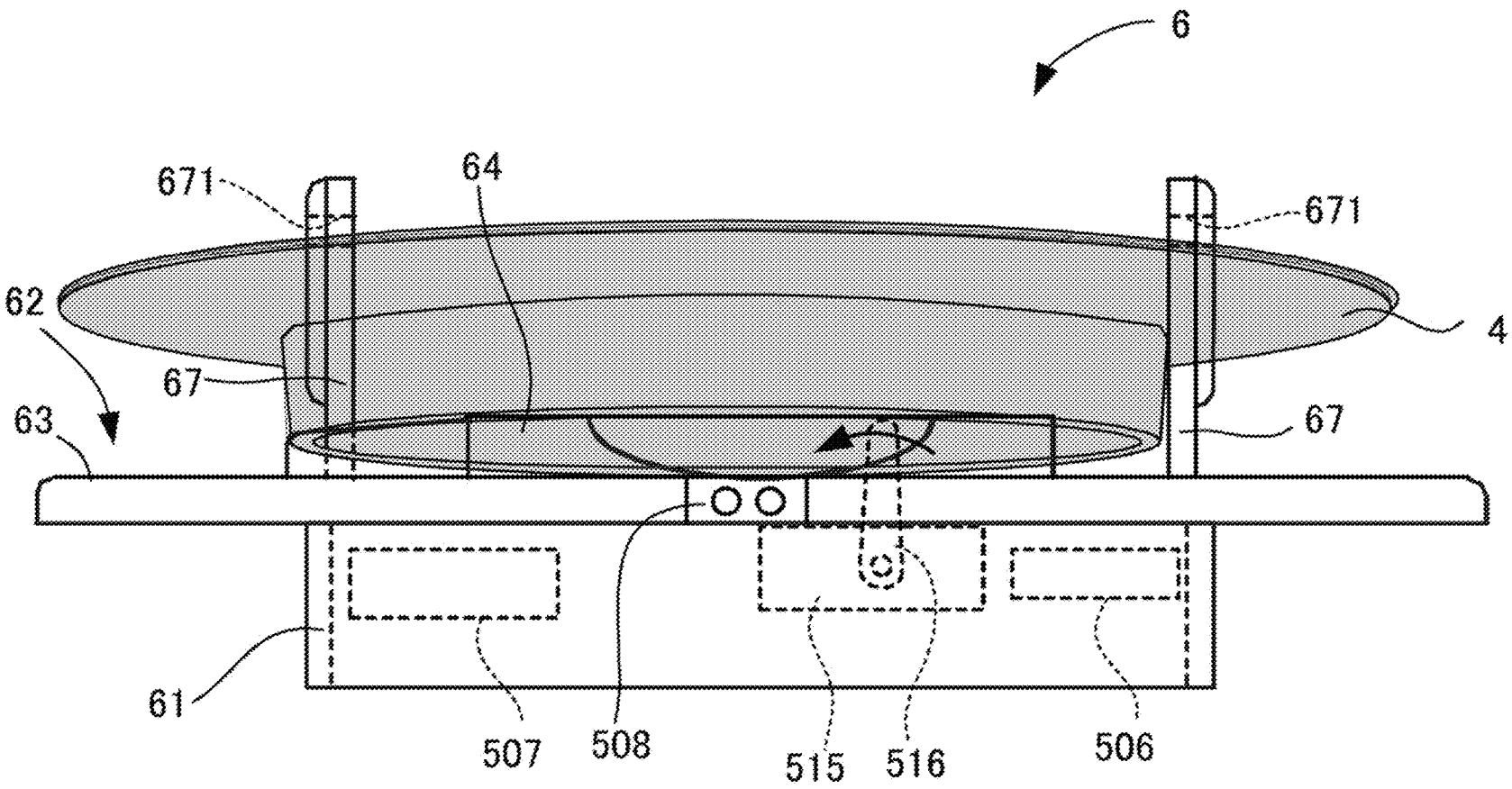
【FIG. 20】

HOUSING BODY

TECHNICAL FIELD

The present invention relates to a housing body that houses a container on which a food and/or beverage item is placed and that is transported along a transport path.

BACKGROUND ART

A food and/or beverage item transport apparatus provided with a transport path that revolves along seats is installed in a restaurant that is generally called a conveyor belt sushi restaurant. A chef places a food and/or beverage item such as sushi on a container such as a plate, and moves the plate on which the food and/or beverage item is placed onto the transport path of the food and/or beverage item transport apparatus, and then successively transports the plate to a seat in such a restaurant. On the other hand, a customer takes desired plates from among plates that are successively transported on the transport path and have food and/or beverage items such as sushi placed thereon, and eats the food and/or beverage items.

Incidentally, sushi on the transport path is likely to dry out due to being transported in a state in which the space above the plate is uncovered, and it is also conceivable that other customers may accidentally touch the sushi. Therefore, problems to be solved include preventing sushi from drying out, and providing sushi in a hygienic manner. In view of this, Patent Literature 1 discloses that a plate on which sushi is placed is covered with a cover member before the plate is conveyed on the transport path of the transport apparatus.

CITATION LIST

Patent Literature

Patent Literature 1: JP 2001-299553A

SUMMARY OF INVENTION

Technical Problem

However, in the method disclosed in Patent Literature 1, the chef needs to directly hold the cover member in his/her hand and place the cover member on the plate, and then place the plate on the transport path together with the cover member. Also, the customer needs to take the transported plate from the transport path together with the cover member, and then detach the cover member from the plate while directly holding the cover member in his/her hand. Further, each time the cover member is to be attached or detached, a chef or a customer attaches the cover member to the plate or detaches the cover member from the plate while holding the cover member in his/her hand, and thus there is a problem that the cover member becomes dirty. Also, because the cover member detached from the plate is left on the table for dining, there is also a problem that the amount of free space on the table decreases.

In view of this, the present invention has been made in order to resolve the above issues, and aims to provide a housing body from which a container such as a plate can be easily taken out without touching a member covering the container.

Solution to Problem

The present invention provides a housing body that is to house a container on which a food and/or beverage item is to be placed and that is to be transported along a transport path, the housing body including: a placement table having a placement position at which the container is to be placed; a lid body that is attached to the placement table so as to be openable and closable; an opening/closing mechanism for causing the lid body to transition to a closed state when the container is placed at the placement position of the placement table, and causing the lid body to transition to an open state when the container moves away from the placement position; and an operation portion for moving the container away from the placement position.

In the housing body, the opening/closing mechanism may include an operation body configured to move from a first position to a second position due to being pressed by the container as the container is placed at the placement position, a connecting means for connecting the operation body to the lid body and causing the lid body to transition from the open state to the closed state as the operation body moves from the first position to the second position, a biasing means for biasing the operation body toward the first position, and a stopper for holding, at the placement position, the container that is pressed by the biasing means via the operation body.

In the housing body, the operation means may include an operation portion that enables a pushing operation, and a lever that pushes the container to move the container away from the placement position in conjunction with the pushing operation performed on the operation portion.

In the housing body, a peripheral edge of the placement table may be provided with a notch, and at least a portion of the operation portion may be disposed in the notch.

In the housing body, the lid body may be attached by a hinge to the placement table so as to be openable and closable, the stopper may be provided on the placement table on a side opposite to the hinge, and the operation portion may be disposed in a vicinity of the stopper.

In the housing body, a notch for gripping the container located at the placement position may be formed in an edge portion of the lid body.

The housing body further includes a sensor configured to detect a hand of a customer that approaches the housing body, in which the operation means may be configured to automatically move the container away from the placement position when the sensor detects that the hand of the customer approaches the housing body.

The housing body further includes: a sensor configured to detect a hand of a customer that approaches the housing body; and an operation member configured to perform a pressing operation on the operation portion when the sensor detects that the hand of the customer approaches the housing body.

Advantageous Effects of Invention

With the housing body according to the present invention, it is possible to easily take out the container such as a plate without touching the member covering the container.

BRIEF DESCRIPTION OF DRAWINGS

FIG. 1 is a plan view of a food and/or beverage item provision system according to an embodiment of the present invention.

FIG. 2 is a cross-sectional view of a transport path.

FIG. 3 is a front view of the transport path.

FIG. 4 is a front view of a housing body in a closed state.

FIG. 5 is a side view of FIG. 4.

FIG. 6 is a front view of the housing body in an open state.

FIG. 7 is a side view of FIG. 6.

FIG. 8 is a plan view of a placement table.

FIG. 9 is a front view of FIG. 8.

FIG. 10 is a side view of FIG. 8.

FIG. 11 is a side view of a lid body.

FIG. 12(*a*) is a plan view of an operation body, FIG. 12(*b*) is a side view of the operation body, and FIG. 12(*c*) is a bottom view of the operation body.

FIG. 13 is a side view of the lid body and the operation body in the closed state.

FIG. 14 is a side view of the lid body and the operation body in the open state.

FIG. 15 is a front view showing another example of the placement table.

FIG. 16 is a front view showing another example of the placement table.

FIG. 17 is a front view showing another example of the placement table.

FIG. 18 is a front view showing another example of the placement table.

FIG. 19 is a front view showing another example of the placement table.

FIG. 20 is a front view showing another example of the placement table.

DESCRIPTION OF EMBODIMENTS

1. Outline of Food and/or Beverage Item Provision System

An embodiment of a food and/or beverage item provision system for transporting a housing body according to the present invention will be described below with reference to the drawings. FIG. 1 is a plan view of the food and/or beverage item provision system, FIG. 2 is a cross-sectional view of the transport path, and FIG. 3 is a front view of the transport path.

As shown in FIGS. 1 and 2, the food and/or beverage item provision system according to the present embodiment is installed in a sushi restaurant, for example, and includes a first transport path 1 along which a housing body 5 for housing a food and/or beverage item is transported between a customer section S1 and a kitchen section S2, and a second transport path 2 along which a plate 4 having an ordered food and/or beverage item placed thereon is transported. The customer section S1 is provided with a plurality of seat booths 3 that are divided by partitions, and each of the seat booths 3 is disposed along the transport paths 1 and 2. A rectangular table 31 is set in each of the seat booths 3 such that one side of the table 31 is in contact with the first transport path 1.

As shown in FIGS. 2 and 3, the second transport path 2 is arranged above the first transport path 1 in parallel therewith. A plate 4 having a food or beverage item (sushi, soup, sweets, a beverage, etc.) placed thereon is housed in the housing body 5 transported via the first transport path 1, and a customer seated in each of the seat booths 3 takes out, from the housing body 5 on the first transport path 1, a plate 4 having a food or beverage item placed thereon, and consumes the food or the beverage at the table 31. On the other hand, because the plate 4 having an ordered food and/or beverage item placed thereon is transported via the second transport path 2, the customer takes the plate 4, and consumes the food or the beverage at the table 31.

Also, as shown in FIG. 2, a touch panel display 32 for ordering, bill settlement, and so forth, and a slotting device 33 for slotting plates 4 are disposed on each table 31 in each seat booth 3. A food and/or beverage item ordered via the touch panel display 32 is transported from the kitchen section S2 to the table 31 where the order has been issued, via the second transport path 2. Also, information regarding ordered food and/or beverage items is stored in a processing device (not shown) as order information. Each of these devices will be described in detail below.

2. Transport Path

As shown in FIG. 2, the first transport path 1 includes two lanes on which a flat chain conveyor 11 is disposed, and the flat chain conveyor 11 is configured to revolve between the customer section S1 and the kitchen section S2, using a motor (not shown). The housing bodies 5 described above are disposed at predetermined intervals on the flat chain conveyor 11, and travel on the first transport path 1.

Next, the second transport path 2 will be described. As shown in FIGS. 2 and 3, the second transport path 2 is supported by support columns 20 disposed on the first transport path 1, and includes two lanes on which a flat chain conveyor 21 is disposed in the same manner as in the first transport path 1. Each flat chain conveyor 21 is configured to transport the plates 4 on which food and/or beverage items are placed, and the housing bodies 5 are not transported on the flat chain conveyors 21. The food and/or beverage items placed on the plates 4 are ordered via the touch panel display 32. Therefore, the plates 4 having the ordered food and/or beverage items placed thereon are transported from the kitchen section S2, and stop at the seat booth 3 where the order has been issued. Thus, if a desired food and/or beverage item is not transported along the first transport path 1, for example, the customer can issue an order via the touch panel display 32.

3. Slotting Device

Next, the slotting device 33 will be described. As shown in FIG. 2, the slotting device 33 includes a guide path 332 having a slot 331 that is open at the table 31 and into which plates 4 are slotted, and a sensor 333 that is provided inside the guide path 332 and detects plates 4 that have passed therethrough. The guide path 332 extends obliquely downward from the table 31, and is connected to a plate collecting channel 22 provided inside the first transport path 1. The plate collecting channel 22 extends to the kitchen section S2, and is connected to a vessel (not shown) provided in the kitchen section S2. Also, water flows through the plate collecting channel 22 toward the vessel. When a plate 4 slotted from the slot 331 drops down into the plate collecting channel 22 via the guide path 332, the plate 4 is carried to the vessel by water. The plate 4 is then collected in the vessel, and is reused after being washed.

When the plate 4 that has passed along the guide path 332 is detected by the sensor 333, the type and the number of plates 4 are transmitted to the above-described processing device, and is stored as slotting information. This slotting information is used at the time of bill settlement, and when a settlement button (not shown) is touched on the touch panel display 32, the number and the types of dishes eaten and the price are displayed on the touch panel display based on the slotting information and the above described order information. When the customer accepts this, a description promoting the customer to pay the fee at a point of sale (POS) register is displayed on the touch panel display 32. Alternatively, settlement processing can also be performed by calling a store staff member and having the staff member count the number of dishes eaten.

4. Housing Body

Next, the housing body 5 will be described with reference to FIGS. 4 to 7. FIG. 4 is a front view of the housing body in the closed state, FIG. 5 is a side view of FIG. 4, FIG. 6 is a front view of the housing body in the open state, and FIG. 7 is a side view of FIG. 6. Note that in FIGS. 4 to 7, the plates 4 are colored and translucent for convenience of description. First, the plates 4 housed in the housing body 5 will be described. As shown in FIG. 4, each plate 4 includes a plate board 41 having a circular shape in a plan view, and a cylindrical base 42 that protrudes downward from a lower surface of the plate board 41, and the plate board 41 and the base 42 are formed as a single body, for example. A food and/or beverage item (not shown) such as sushi is placed on the plate board 41.

The housing body 5 will be described next. As shown in FIGS. 4 to 7, the housing body 5 includes a placement table 6 having a placement position where the plate 4 is placed, a lid body 7 for covering the upper surface of the placement table 6, and an opening/closing mechanism 80 for closing the lid body 7 when the plate 4 is placed at the placement position and for opening the lid body 7 when the plate 4 is taken out from the placement position. Also, the housing body 5 is provided with an operation member (operation means) 9 for moving the plate 4 away from the placement position. The following describes each member in detail. Note that, for convenience of description, the following description will be given with reference to directions shown in FIGS. 4 to 7. However, the present invention is not limited to these directions.

4-1. Placement Table

FIG. 8 is a plan view of the placement table and the operation member, FIG. 9 is a front view of FIG. 8, and FIG. 10 is a side view of FIG. 8. However, for convenience of description, the operation member 9 is not shown in FIG. 8. As shown in FIGS. 8 and 9, the placement table 6 includes a cylindrical base cylinder 61 and a placement portion 62 provided at an upper end of the base cylinder 61, and the base cylinder 61 and the placement portion 62 are formed as a single body. The plate 4 is placed on an upper surface of the placement portion 62, and the plate 4 is held at a placement position, which will be described later. The placement portion 62 includes a placement plate 63 having a circular shape in a plan view, a stopper 64 disposed at a front portion of the upper surface of the placement plate 63, and a pair of support pieces 67 that are arranged at a rear end portion of the placement plate 63 and support the lid body 7 such that the lid body 7 is openable and closable. Also, a first arc-shaped notch portion 631 is formed somewhat rightward of the center of a front edge of the placement plate 63, and a second rectangular notch portion 632 that extends leftward from the first notch portion 631, and the first notch portion 631 and the second notch portion 632 are continuous with each other. Also, the placement plate 63 is provided with a pair of attachment pieces 633 to which an operation member 65 is attached so as to hold a right end portion of the second notch portion 632 from the front and the rear. The pair of attachment pieces 633 are formed so as to extend upward from the placement plate 63, and a through-hole is formed near an upper end thereof.

The stopper 64 protrudes from the placement plate 63 and extends leftward from the above-described first notch portion 631 along the front edge of the placement plate 63. Also, the rear edge of the stopper 64 is provided with a first inner peripheral surface 641 that linearly extends along the front edge of the second notch portion 632, and a second arc-shaped inner peripheral surface 642 that is continuous with the left end of the first inner peripheral surface 641 and extends toward the left side of the placement plate 63. The first inner peripheral surface 641 is provided on the right side of the placement plate 63, and the second inner peripheral surface 642 extends to the vicinity of the center in the front-back direction of the placement plate 63 so as to have a central angle of about 90 degrees. Also, the outer circumferential surface of the base 42 of the plate 4 comes into contact with the second inner peripheral surface 642.

Also, a recess 635 having a rectangular shape in a plan view is formed in the upper surface of the placement plate 63 rearward of the center thereof in the front-back direction, and the operation body 8, which will be described later, is disposed in the recess 635. Further, a plurality of elongated through-holes 636 that extend in the front-back direction are formed in the bottom surface of the recess 635, and as will be described later, protrusions 811 of the operation body 8 are respectively inserted into the through-holes 636. As will be described later, the base 42 of the plate 4 is also sandwiched between the second inner peripheral surface 642 of the stopper 64 and the operation body 8, and thus, the plate 4 is held by the placement table 6. In this case, the position where the plate 4 is placed is referred to as "placement position". FIGS. 4 and 5 show the state in which the plate 4 is located at the placement position.

As shown in FIGS. 9 and 10, the pair of support pieces 67 described above are attached onto the placement plate 63 such that the recess 635 is interposed therebetween, and extend upward from the placement plate 63. Also, a through-hole 671 is formed in the upper end of each support piece 67, and a protrusion 73 of the lid body 7 is rotatably inserted into the through-hole 671 so that the lid body 7 can be opened and closed. That is, the support pieces 67 function as hinges for opening and closing the lid body 7 relative to the placement portion 62.

4-2. Operation Member

As shown in FIGS. 8 and 9, the operation member 9 includes an operation portion 91 having a circular shape in a plan view, and a rectangular lever 92 that extends leftward from the operation portion 91, and the operation portion 91 and the lever 92 are formed as a single body. Also, the operation portion 91 is disposed in the above-described first notch portion 631, and the lever 92 is disposed in the second notch portion 632. The operation portion 91 is disposed so as to somewhat protrude from the first notch portion 631. Protrusions 921 that respectively protrude forward and backward are formed in the vicinity of the right end portion of the lever 92, and the protrusions 921 are rotatably attached to the through-holes in the above-described attachment pieces 633. As a result, the operation member 9 can swing about the protrusions 921. As shown in FIG. 9 using a solid line, in a first state, which is the initial state, the lever 92 is substantially housed in the second notch portion 632, and the operation portion 91 is disposed slightly above the first notch portion 631. When the operation portion 91 is pushed downward in the first state, as shown in FIG. 9 using a dashed line, the left end portion of the lever 92 can swing upward of the second notch portion 632 (the upper surface of the placement plate 63). This state will be referred to as "second state".

Also, a front edge of the lever 92 extends along the first inner peripheral surface 641 of the stopper 64, and only a front edge of a leading end portion 922 of the lever 92 extends along the second inner peripheral surface 642. However, the leading end portion 922 has a short length in the right-left direction, and is located on the right side of the center of the placement plate 63.

4-3. Lid Body

FIG. 11 is a side view of the lid body. As shown in FIG. 11, the lid body 7 includes a dome-shaped lid main body 71 and a pair of left and right arm pieces 72 that extend downward from the rear end portion of the lid main body 71, and the lid main body 71 and the arm pieces 72 are formed as a single body. The lid main body 71 and the arm pieces 72 are made of a transparent synthetic resin material, making it possible to see the inside of the lid body 7 from the outside. The above-described protrusion 73 is formed in the vicinity of the upper end of each arm piece 72, and each protrusion 73 is rotatably fitted to the through-hole 671 in the support piece 67 of the placement portion 62. Each protrusion 73 protrudes in the right-left direction, and thus the lid body 7 is openable and closable relative to the placement plate 63 through rotation about a pivot axis L (see FIG. 4 etc.) that passes through the two protrusions 73 and extends in the right-left direction.

Also, an elongated notch 75 that extends upward is formed in a lower end of each arm piece 72. A connection shaft 85 of the later-described operation body 8 is inserted into each notch 75.

The outer diameter of the lid body 7 is substantially the same as the outer diameter of the placement plate 63, and as shown in FIG. 4, when the lid body 7 is in the closed state, the lower edge of the lid body 7 is disposed above a circumferential edge portion of the placement plate 63 with a gap interposed therebetween. The plate 4 is housed in this gap. Further, as shown in FIG. 4, the lower edge of the front portion of the lid body 7 is provided with an arc-shaped notch 76, and the housed plate 4 can be gripped via the notch 76. The uppermost portion of the lid body 7 is provided with a through-hole 77, and a display tag 79 indicating the type of food and/or beverage item contained in each lid body 7 is attached to the through-hole 77. It is possible to display types of sushi such as tuna or sea bream on the display tag 79, for example.

4-4. Opening/Closing Mechanism

Next, the opening/closing mechanism will be described. As shown in FIGS. 5 and 7, an opening/closing mechanism 80 includes an operation body 8 disposed on the placement plate 63, and a coil spring (biasing means) 83 for biasing the operation body 8 forward.

First, the operation body 8 will be described. FIG. 12(*a*) is a plan view of the operation body, FIG. 12(*b*) is a side view of the operation body, and FIG. 12(*c*) is a bottom view of the operation body. As shown in FIG. 12, the operation body 8 includes a plate-shaped main portion 81 that is disposed in the above-described recess 635 in the placement plate 63 and slides in the recess 635 in the front-back direction, and a support portion 82 that protrudes upward from a rear portion of the main portion 81. Although the support portion 82 is rectangular in a plan view, the front portion of the support portion 82 is provided with an inner circumferential surface 821 that is recessed rearward in an arc shape, and the inner circumferential surface 821 comes into contact with the outer circumferential surface of the base 42 of the plate 4. That is, the inner circumferential surface 821 of the operation body 8 and the second inner peripheral surface 642 of the stopper 64 hold the base 42 of the plate 4.

As shown in FIG. 12(*c*), the lower surface of the main portion 81 is provided with a plurality of protrusions 811 that extend in the front-back direction, and as described above, these protrusions 811 are fitted to the through-holes 636 formed in the bottom surface of the recess 635 of the placement plate 63. As a result, the main portion 81 is slidable in the front-back direction while the main portion 81 is being guided by the protrusions 811 and the through-holes 636. Also, as shown in FIG. 5 etc., the above-described coil spring 83 is attached to the lower surface of the placement plate 63 between a center protrusion 811*a* in the right-left direction among the plurality of protrusions 811 and the attachment portion 638 formed forward of the protrusion 811*a*. The operation body 8 is constantly biased forward by the coil spring 83. However, as shown in FIG. 14, which will be described later, the main portion 81 of the operation body 8 is disposed in the recess 635 of the placement plate 63, and a front wall of the recess 635 servers as a stopper. Therefore, the main portion 81 is configured not to move further forward due to the front wall, although the main portion 81 is biased forward.

Also, as shown in FIG. 12, protruding pieces 84 that extend obliquely upward and rearward are formed on both sides of the rear end of the support portion 82. The connection shaft 85 that extends in the right-left direction is formed in the vicinity of the upper end of each protruding piece 84, and each connection shaft 85 is inserted into the notch 75 formed in the arm piece 72 of the lid body 7 and is movable within the notch 75. Note that the connection shaft 85 is inserted into the notch 75 below the pivot axis L.

Next, how the operation body opens/closes the lid body will be described. FIG. 13 shows the lid body in the closed state, and FIG. 14 shows the lid body in the open state. FIGS. 13 and 14 mainly show the lid body 7 and the operation body 8, and the support pieces 67 of the placement table 6 are not shown in FIGS. 13 and 14 for convenience of description.

Because the operation body 8 is constantly biased forward by the coil spring 83, as shown in FIG. 14, the operation body 8 is in contact with the front wall of the recess 635 when no external force is applied. As a result, the connection shafts 85 push the lower end portions of the arm pieces 72 forward. That is, because the connection shafts 85 press forward the lower end portions of the arm pieces 72 below the pivot axis L, the lid body 7 swings upward about the swing axis L, reaching the open state. Because the operation body 8 is constantly biased forward by the coil spring 83, in the initial state, the lid body 7 is in the open state.

When the operation body 8 is moved rearward against the coil spring 83 in this state, the connection shafts 85 push the arm pieces 72 rearward as shown in FIG. 13. As a result, the lid body 7 is pressed rearward below the pivot axis L, the lid body 7 swings downward about the pivot axis L, reaching the closed state. In this process, the connection shafts 85 move upward through the notches 75 of the arm pieces 72.

5. Method for Using Housing Body

Next, a method for using the housing body 5 will be described. First, a chef places a food and/or beverage item (not shown) such as sushi on the plate board 41 of the plate 4, and places the plate 4 on the housing body 5 that is placed on the first transport path 1 and is in the open state while holding the circumferential edge portion of the plate board 41 in his/her hand. That is, in the state shown in FIG. 7, the plate 4 is pushed backward relative to the placement plate 63. At this time, the base 42 of the plate 4 is brought into contact with the inner circumferential surface 821 of the operation body 8, and the plate 4 is pressed backward together with the operation body 8. By engaging the base 42 of the plate 4 with the second inner peripheral surface 642 of the stopper 64, the base 42 is held between the operation body 8 and the stopper 64. At this time, the lever 92 of the operation member 9 is pushed downward of the base 42. In this process, because the operation body 8 moves backward, the lid body 7 swings downward to reach the closed state as shown in FIGS. 4 and 5. Accordingly, because the space above the plate 4 is covered with the lid body 7, the sushi is protected by the lid body 7, thus preventing dust and the like from adhering thereto. However, because the lid body 7 is transparent, the sushi inside the lid body 7 can be seen from outside. Note that, because the operation body 8 is biased forward by the coil spring 83, the base 42 of the plate 4 is pushed into the operation body 8. Therefore, the base 42 is tightly held between the operation body 8 and the stopper 64. As a result, the lid body 7 is kept closed and thus is not opened unintentionally.

The housing body 5 in which the plate 4 is disposed is transported along the first transport path 1, and the plate 4 is taken out from the housing body 5 by a customer at the table 31. The following describes this operation.

The customer can take out the plate 4 from the housing body 5 using two methods. One of the methods is a method for pressing the operation portion 91 of the operation member 9. When the customer pushes the operation portion 91 downward in the state shown in FIGS. 4 and 5, the lever 92 pushes up the base 42 in the vicinity of the stopper 64 as shown in FIG. 6. As a result, when the base 42 is moved away from the stopper 64, the base 42 is pushed forward by the operation body 8 biased by the coil spring 83. Because the operation body 8 moves forward in this process, the lid body 7 swings upward and reaches the open state as shown in FIGS. 6 and 7. In this state, the customer can take out the plate 4 from the housing body while gripping the plate board 41.

In the other method, fingers are inserted through the notch 76 of the lid body 7 in the state shown in FIGS. 4 and 5, and the plate board 41 is pushed upward while the plate board 41 is being gripped with the fingers. As a result, when the base 42 is moved away from the stopper 64, the base 42 is pushed forward by the operation body 8. Because the operation body 8 moves forward in this process, the lid body 7 swings upward accompanying this forward movement and reaches the open state. In this state, the customer can take out the plate 4 from the housing body 5 while gripping the plate board 41.

6. Features

As described above, the housing body 5 according to this embodiment can provide the following effects.

(1) When the operation portion 91 is pushed in, the lever 92 pushes up the base 42 of the plate 4, and thus the base 42 and the stopper 64 are disengaged. As a result, the plate 4 is pushed forward and the lid body 7 opens, and thus, the plate 4 can be taken out from the housing body 5 without touching the lid body 7.

(2) The operation portion 91 is disposed on the placement plate 63 at a position facing the table 31. That is, the operation portion 91 is disposed in the first notch portion 631 formed in the front portion of the placement plate 63 such that a portion of the operation portion 91 protrudes from the first notch portion 631 outward of the placement plate 63. Thus, the customer can visually recognize the operation portion 91 with ease, and easily perform a pushing operation. If the operation portion 91 is colored or marked with "Push" or the like, the customer can intuitively take out the plate 4 from the housing body 5 without any special instruction, for example.

(3) Because the lever 92 of the operation member 9 is disposed in the vicinity of the stopper 64, it is possible to prevent the lever 92 from interfering with placement of the plate 4 at the placement position. That is, when disposing the plate 4 on the placement plate 63, the plate 4 is disposed, from above, on the placement plate 63 with the plate 4 facing slightly obliquely downward relative to the operation body 8. Therefore, the lever 92 disposed in the front portion of the placement plate 63 tends not to interfere with placement of the plate 4 thereon. Also, because the lever 92 is disposed in the vicinity of the stopper 64, the base 42 can be pushed up in the vicinity of the stopper 64. Therefore, the base 42 can be easily moved away from the stopper 64.

(4) Because the notch 76 is formed in the front portion of the lid body 7, as described above, the plate 4 can be moved away from the placement position and the housing body 5 can be taken out therefrom by inserting fingers through the notch 76, gripping the plate 4, and moving upward the plate 4 in this state. Therefore, the plate 4 can be taken out using a method other than the method in which the operation member 9 is used. With this method, the plate 4 can be taken out without touching the housing body 5.

7. Modification Examples

Although an embodiment of the present invention has been described above, the present invention is not limited to the above-described embodiment, and various modifications can be made without departing from the gist of the invention. Note that the following modification examples may be combined as appropriate.

(1) The opening/closing mechanism 80 described in the above embodiment is an example, and need only be configured to cause the lid body 7 to transition to the closed state when the plate 4 is placed at the placement position, and cause the lid body 7 to transition to the open state when the plate 4 moves away from the placement position. Examples thereof include the following examples.

(1-1)

FIG. 15 is a front view showing a first other example of the placement table. As shown in FIG. 15, the placement table 6 differs from that in the above embodiment in that the operation member 9 is operated using a machine. A bracket 501 is attached to the edge portion of the placement plate 63 of the placement table 6 in the vicinity of the operation member 9, and an upper portion of the bracket 501 is provided with a support portion 502 disposed above the placement plate 63. Also, a spring 504 is provided between the support portion 502 and the operation portion 91 of the operation member 9, and the operation portion 91 is constantly biased downward by the spring 504. On the other hand, a servomotor 503 disposed below the placement plate 63 is attached to a lower portion of the bracket 501, and an arm 505 is rotatably attached to the servomotor 503. The arm 505 is pivoted by the servomotor 503 between the initial position shown in FIG. 15 and a retraction position shown in FIG. 16. The arm 505 is positioned to extend upward at the initial position, and accordingly presses the operation portion 91 from below. Therefore, because the operation portion 91 is pushed upward by the arm 505 while the operation portion 91 is being biased by the spring 504 from above, the operation member 9 is kept in the above-described first state. As shown in FIGS. 4 and 5, the plate 4 is housed in the housing body 5 in this state.

A controller 506 and a battery 507 are provided in the base cylinder 61 of the placement table 6 in order to drive the servomotor 503. Also, a sensor 508 that is electrically connected to the controller 506 is provided at a front end portion of the placement plate 63. The sensor 508 is provided with a light emitting device 509 and a light receiving device 510, and the sensor 508 is configured such that, when light is emitted forward from the light emitting device 509 and the light strikes an obstacle and is reflected, the light is received by the light receiving device 510, and the detection state of the sensor 508 is switched to ON. That is, when the customer brings his/her hand closer to the placement table 63 in order to pick up the plate 4 in the state shown in FIGS. 4 and 5, light emitted from the light emitting device 509 is reflected by the hand and is received by the light receiving device 510. When the detection state of the sensor is switched to ON in this manner, the controller 506 drives the servomotor 503, and the arm 505 rotates once. If the arm 505 deviates from the initial position as shown in FIG. 16 during one rotation, for example, the operation portion 91 is no longer supported by the arm 505. Therefore, the operation portion 91 is pushed by the spring 504 and moves downward. As a result, because the operation member 9 transitions to the above-described second state, the lid body 7 is opened and the plate 4 is pushed forward as shown in FIGS. 6 and 7. Also, when the arm 505 rotates once, the arm 505 returns to the initial position shown in FIG. 15, and the operation portion 91 is pushed up by the arm 505 again, and the operation member 9 returns to the first state.

With the configuration described above, because the operation member 9 is automatically operated when the customer brings his/her hand closer to the housing body 5 and the sensor 508 detects the hand, it is possible to eliminate the need for the customer to operate the operation member 9 in order to take out the plate 4 from the housing body 5. Note that the above-described servomotor 503, spring 504, arm 505, and the like correspond to operation members of the present invention.

(1-2)

FIG. 17 is a front view showing a second other example of the placement table. Note that constituent elements that are the same as in (1-1) above are given the same reference numerals and are not described in the following description. As shown in FIG. 17, a solenoid actuator 512 supported by a bracket 511 is provided on the placement plate 63 of the placement table 6, and the solenoid actuator 512 is disposed above the operation portion 91 of the operation member 9. The solenoid actuator 512 is provided with a movable iron core 513 that can move in the vertical direction. The movable iron core 513 is configured to move downward when current temporarily flows through an electromagnetic coil (not shown) built into the solenoid actuator 512. Also, a push bar 514 is provided on a lower portion of the solenoid actuator 512 that can move in the vertical direction, and the push bar 514 is configured to move forward and backward relative to the operation portion 91 in conjunction with vertical movement of the movable iron core 513. More specifically, when the detection state of the sensor 508 is switched to ON, the controller 506 drives the solenoid actuator 512 and moves the push bar 514 downward. Also, a spring (not shown) is provided in the solenoid actuator 512, and when application of current to the electromagnetic coil is stopped, the movable iron core 513 is biased upward by the spring so as to return to the original position. The push bar 514 is also moved upward in conjunction with this.

Therefore, when the detection state of the sensor 508 is switched to ON due to the customer attempting to take out the plate 4 in the state shown in FIG. 17 in which the operation member 9 is in the first state, current temporarily flows through the electromagnetic coil, and the movable iron core 513 moves downward. When the push bar 514 pushes the operation portion 91 downward in conjunction therewith, the operation member 9 transitions to the second state as shown in FIG. 18, and the lid body 7 is opened and the plate 4 is pushed forward as shown in FIGS. 6 and 7. Also, when application of the current to the electromagnetic coil is stopped, the movable iron core 513 is moved upward by the spring together with the push bar. As a result, the operation member returns to the state shown in FIG. 17. Because the operation member 9 is also automatically operated in this example, it is possible to eliminate the need for the customer to operate the operation member 9 in order to take out the plate 4 from the housing body 5. Note that the above-described solenoid actuator 512, push bar 514, and the like correspond to operation members of the present invention.

(1-3)

FIG. 19 is a front view showing a third other example of the placement table. Note that constituent elements that are the same as in (1-1) above are given the same reference numerals and are not described in the following description. As shown in FIG. 19, the operation member 9 is not attached to the placement table 6, and instead, a servomotor 515 connected to the controller 506, and an arm 516 that is rotatably attached to the servomotor 515 are provided inside the base cylinder 61. Also, the rotated arm 516 protrudes upward from the placement plate 63 via the above-described second notch portion 632.

As shown in FIG. 19, when the plate 4 is held in the housing body 5, the arm 516 is positioned so as to extend in the horizontal direction below the second notch portion 632. Therefore, the arm 516 is not in contact with the plate 4. The arm 516 is configured to rotate once when the detection state of the sensor 508 is switched to ON due to the customer attempting to take out the plate 4 in this state. When the arm 516 is moved to the position shown in FIG. 20 during one rotation, the arm 516 pushes up the base 42 of the plate via the second notch portion 632, and the plate 4 moves away from the stopper 64 and is pushed forward. Accordingly, the lid body 7 is opened as described above, and the plate 4 can be taken out. Then, when the arm 516 is rotated once, the arm 516 returns to the initial position shown in FIG. 19, achieving a state in which the plate 4 can be housed in the housing body 5 again. In this example, it is possible to automatically achieve a state in which the plate 4 can be taken out from the housing body 5 without providing the operation member. The servomotor 515 and the arm 516 in (1-3) correspond to operation means of the present invention.

Note that it is also possible to used the solenoid actuator 512 described in (1-2) instead of the servomotor 515 and the arm 516. Also, although the battery 507 is provided in the housing body 5 and current is supplied to the controller 506, the servomotor 503 and 515, the solenoid actuator 512, and the sensor 508 in the above examples, there is no particular limitation on the position where the battery is provided, and current can also be supplied by wires or wirelessly without providing a battery. Further, there is no particular limitation on the configuration of the sensor 508, and the sensor need only detect motion of the customer who is to take out the plate 4, for example.

(2) There is no particular limitation on the shapes of the placement table 6, the lid body 7, and the plate 4, and any shape other than the circular shape in a plan view may be adopted. Further, these shapes can also be modified as appropriate according to the shape of the plate 4.

(3) There is no particular limitation on the configuration of the operation member 9 as long as the plate 4 can be moved away from the placement position through a customer operation. That is, various configurations are possible as long as the plate 4 can be moved so as to be able to disengage the plate 4 and the stopper 64 through a customer operation (4) The notch 76 of the lid body 7 is not essential, and a configuration may be adopted in which the plate 4 can be taken out from the housing body 5 using only the operation member 9.

(5) Although the plate 4 is exemplified as the container of the present invention in the above embodiment, a container other than the plate 4 may also be used. In this case, it is sufficient that a portion of the container is held between the stopper 64 and the operation body 8.

(6) The number of plates taken out from the first transport path 1 is calculated by slotting the plates 4 into the slot 331 in the above embodiment. However, there is no particular limitation on the method for calculating the number of plates 4, and images of the housing body 5 transported along the first transport path 1 may be captured using a camera, and the number of plates 4 taken out from the housing body 5 can also be calculated through image processing. Further, the above-described settlement processing is also an example, and can be modified as appropriate.

(7) Although the ordered food and/or beverage item is transported along the second transport path 2 in the above embodiment, a configuration may be adopted in which only the first transport path 1 is used as a transport path, and the plate 4 having the ordered food and/or beverage item placed thereon can also be transported along the first transport path 1. In this case, a mark or the like (e.g., the number of the seat booth 3, order details, etc.) that indicates the order needs to be attached to the ordered plate 4.

(8) Although the sushi provision system was described in the above embodiment, the housing body of the present invention can also be used for providing food and/or beverage items other than sushi. Further, the configuration of the transport paths and the configuration of the seat booth described above are merely examples, and can be modified as appropriate. Also, a slotting device is not essential, and there is no particular limitation on the method for counting the number of plates. Therefore, the number and types of plates can also be counted by the staff member.

LIST OF REFERENCE NUMERALS

1 First transport path
4 Plate
6 Placement table
64 Stopper
7 Lid body
8 Operation body
82 Coil spring (biasing means)
9 Operation member (operation means)
91 Operation portion
92 Lever

The invention claimed is:

1. A housing body that is to house a container having a plate and a base that protrudes in a downward direction from the plate, a food and/or beverage item being to be placed on the plate, the housing body being to be transported along a transport path, the housing body comprising:

a placement table having a placement position at which the container is to be placed;

a lid body that is attached to the placement table so as to be openable and closable;

an opening/closing mechanism for causing the lid body to transition to a closed state when the container is placed at the placement position of the placement table, and causing the lid body to transition to an open state when the container moves away from the placement position; and an operation means for moving the container away from the placement position, wherein the operation means is disposed in the placement table and is configured to press the base in an upper direction from a lower side of the base, and the lid body is caused to transition to the open state when the container moves away from the placement position by the operation means pressing the base in the upper direction.

2. The housing body according to claim 1, wherein the opening/closing mechanism includes:

an operation body configured to move from a first position to a second position due to being pressed by the container as the container is placed at the placement position, a connection shaft for connecting the operation body to the lid body and causing the lid body to transition from the open state to the closed state as the operation body moves from the first position to the second position, a biasing means for biasing the operation body toward the first position, and a stopper for holding, at the placement position, the container that is pressed by the biasing means via the operation body.

3. The housing body according to claim 2, wherein the operation means includes:

an operation portion that enables a pushing operation, and a lever that pushes the container to move the container away from the placement position in conjunction with the pushing operation performed on the operation portion.

4. The housing body according to claim 3, wherein a peripheral edge of the placement table is provided with a notch portion, and at least a portion of the operation portion is disposed in the notch.

5. The housing body according to claim 2, wherein the lid body is attached by a hinge to the placement table so as to be openable and closable, the stopper is provided on the placement table on a side opposite to the hinge, and the operation portion is disposed in a vicinity of the stopper.

6. The housing body according to claim 1, wherein a notch for gripping the container located at the placement position is formed in an edge portion of the lid body.

7. The housing body according to claim 1, further comprising:

a sensor configured to detect a hand of a customer that approaches the housing body, wherein the operation means is configured to automatically move the container away from the placement position when the sensor detects that the hand of the customer approaches the housing body.

8. The housing body according to claim 3, further comprising:

a sensor configured to detect a hand of a customer that approaches the housing body; and an operation member configured to perform a pressing operation on the operation portion when the sensor detects that the hand of the customer approaches the housing body.

9. The housing body according to claim 3, wherein the lid body is attached by a hinge to the placement table so as to be openable and closable, the stopper is provided on the placement table on a side opposite to the hinge, and the operation portion is disposed in a vicinity of the stopper.

10. The housing body according to claim 4, wherein the lid body is attached by a hinge to the placement table so as to be openable and closable, the stopper is provided on the placement table on a side opposite to the hinge, and the operation portion is disposed in a vicinity of the stopper.

11. The housing body according to claim 2, wherein a notch for gripping the container located at the placement position is formed in an edge portion of the lid body.

12. The housing body according to claim 3, wherein a notch for gripping the container located at the placement position is formed in an edge portion of the lid body.

13. The housing body according to claim 4, wherein a notch for gripping the container located at the placement position is formed in an edge portion of the lid body.

14. The housing body according to claim 2, further comprising:

a sensor configured to detect a hand of a customer that approaches the housing body, wherein the operation means is configured to automatically move the container away from the placement position when the sensor detects that the hand of the customer approaches the housing body.

15. The housing body according to claim 3, further comprising:

a sensor configured to detect a hand of a customer that approaches the housing body, wherein the operation means is configured to automatically move the container away from the placement position when the sensor detects that the hand of the customer approaches the housing body.

16. The housing body according to claim 4, further comprising:

a sensor configured to detect a hand of a customer that approaches the housing body, wherein the operation means is configured to automatically move the container away from the placement position when the sensor detects that the hand of the customer approaches the housing body.

17. The housing body according to claim 4, further comprising:

a sensor configured to detect a hand of a customer that approaches the housing body; and an operation member configured to perform a pressing operation on the operation portion when the sensor detects that the hand of the customer approaches the housing body.

18. The housing body according to claim 1, further comprising a motor that is configured to drive the operation means, wherein the operation means is further configured to automatically move the lid body from the placement position by the motor.

19. A housing body that is conveyed along a transport path and houses a container having a plate and a base that protrudes in a downward direction from the plate, a food and/or beverage item being placed on the plate, the housing body comprising:

a placement table on which the container is placed at a placement position;

a lid body that is rotatably attached to the placement table and configured to open and close;

an opening/closing member that is configured to:

close the lid body when the container is placed at the placement position of the placement table; and open the lid body when the container is moved away from the placement position; and an operation member that is disposed in the placement table and is configured to press the base in an upper direction from a lower side of the base, and the lid body is closed when the container is moved away from the placement position by the pressing portion pressing the container in the upper direction.

20. The housing body according to claim 19, wherein the operation member includes a lever that is rotatably disposed in the placement table, and the lever is configured to press the base in the upper direction to move the container away from the placement position.

21. The housing body according to claim 19, wherein the opening/closing member further comprises:

an operation body configured to move from a first position to a second position by a pressing force by the container when the container is placed at the placement position, a connection shaft that is configured to connect the operation body to the lid body and shift the lid body from an opening state to a closed state as the operation body moves from the first position to the second position, a biasing member that is configured to bias the operation body toward the first position, and a stopper that is configured to hold, at the placement position, the container that is pressed by the biasing member via the operation body.

22. The housing body according to claim 19, further comprising an actuator that is configured to drive the operation member, wherein the operation member is further configured to automatically move the lid body from the placement position by the actuator.

23. The housing body according to claim 22, wherein the actuator is a motor that is configured to drive the operation member to automatically move the lid body from the placement position.

* * * * *